US012808152B2

(12) United States Patent
Mochimaru

(10) Patent No.: US 12,808,152 B2
(45) Date of Patent: Nov. 24, 2026

(54) WORK MACHINE

(71) Applicant: KOMATSU LTD., Tokyo (JP)

(72) Inventor: Yuya Mochimaru, Tokyo (JP)

(73) Assignee: KOMATSU LTD., Tokyo (JP)

( * ) Notice: Subject to any disclaimer, the term of this patent is extended or adjusted under 35 U.S.C. 154(b) by 257 days.

(21) Appl. No.: 18/710,852

(22) PCT Filed: Nov. 15, 2022

(86) PCT No.: PCT/JP2022/042425
§ 371 (c)(1),
(2) Date: May 16, 2024

(87) PCT Pub. No.: WO2023/100646
PCT Pub. Date: Jun. 8, 2023

(65) Prior Publication Data

US 2024/0426078 A1 Dec. 26, 2024

(30) Foreign Application Priority Data

Dec. 3, 2021 (JP) ..... 2021-197393

(51) Int. Cl.
*E02F 9/18* (2006.01)
*E02F 9/08* (2006.01)

(52) U.S. Cl.
CPC . *E02F 9/18* (2013.01); *E02F 9/08* (2013.01)

(58) Field of Classification Search
CPC ..... E02F 9/18; E02F 9/08
See application file for complete search history.

(56) References Cited

U.S. PATENT DOCUMENTS 4,571,147 A * 2/1986 Schaeff ..... E02F 9/0808 414/694
12,584,290 B2 * 3/2026 Kimura ..... E02F 9/2025
(Continued)

FOREIGN PATENT DOCUMENTS

CN 103380252 A 10/2013
JP 11-1940 A 1/1999
(Continued)

OTHER PUBLICATIONS

The International Search Report for the corresponding international application No. PCT/JP2022/042425, issued on Dec. 20, 2022.
(Continued)

*Primary Examiner* — Erez Gurari
(74) *Attorney, Agent, or Firm* — Spencer Fane LLP

(57) ABSTRACT

A hydraulic excavator includes a vehicle body, a counterweight, a mount bracket, and an operating portion. The counterweight is configured to be attachable to and detachable from a frame portion of a rear part of the vehicle body. The mount bracket is disposed on the frame portion and configured to be changeable between a mounted state and a demounted state. The mount bracket is changed into the mounted state in mounting the counterweight thereto, with the counterweight being attached to the vehicle body. The mount bracket is changed into the demounted state in detachment of the counterweight from the vehicle body. The operating portion is disposed on an opposite side of the counterweight on the frame portion as seen in a back-and-forth direction of the vehicle body. The operating portion is operated such that the mount bracket is changed into either the mounted state or the demounted state.

20 Claims, 26 Drawing Sheets

(56) References Cited

U.S. PATENT DOCUMENTS

| | | | | |
|---|---|---|---|---|
| 2003/0168421 | A1* | 9/2003 | Davis | B66C 23/78 212/302 |
| 2006/0103125 | A1 | 5/2006 | Yamamoto | |
| 2007/0122261 | A1* | 5/2007 | Hamaguchi | E02F 9/18 414/729 |
| 2012/0315121 | A1* | 12/2012 | Halepatali | E02F 3/627 414/800 |
| 2014/0262570 | A1* | 9/2014 | Sho | E02F 9/20 180/54.1 |
| 2016/0122973 | A1* | 5/2016 | Lyle | E02F 3/301 414/687 |
| 2017/0210432 | A1* | 7/2017 | Cartechini | B62D 49/085 |
| 2018/0171589 | A1 | 6/2018 | Iwamoto et al. | |
| 2018/0195253 | A1 | 7/2018 | Iwamoto et al. | |
| 2020/0165794 | A1* | 5/2020 | Takebayashi | E02F 9/2275 |
| 2021/0270011 | A1* | 9/2021 | Son | B62D 49/085 |
| 2021/0317633 | A1* | 10/2021 | Sherlock | E02F 9/18 |
| 2022/0034064 | A1* | 2/2022 | Gorman | E02F 9/0866 |
| 2024/0376689 | A1* | 11/2024 | Tsujimoto | E02F 3/32 |
| 2024/0401307 | A1* | 12/2024 | Ishii | E02F 9/24 |
| 2024/0426078 | A1* | 12/2024 | Mochimaru | E02F 9/08 |
| 2025/0230630 | A1* | 7/2025 | Kimura | E02F 3/435 |
| 2025/0305244 | A1* | 10/2025 | Maruyama | E02F 9/18 |

FOREIGN PATENT DOCUMENTS

| | | | |
|---|---|---|---|
| JP | 2006-44948 | A | 2/2006 |
| JP | 2012-57299 | A | 3/2012 |
| JP | 2016-55935 | A | 4/2016 |
| JP | 2017-8513 | A | 1/2017 |
| JP | 2017-8514 | A | 1/2017 |

OTHER PUBLICATIONS

The Chinese Office Action for the corresponding Chinese patent application No. 202280075473.0 issued on May 19, 2026.

* cited by examiner

WORK MACHINE

CROSS-REFERENCE TO RELATED APPLICATIONS

This application is a U.S. National stage application of International Application No. PCT/JP2022/042425, filed on Nov. 15, 2022. This U.S. National stage application claims priority under 35 U.S.C. § 119(a) to Japanese Patent Application No. 2021-197393, filed in Japan on Dec. 3, 2021, the entire contents of which are hereby incorporated herein by reference.

BACKGROUND

Technical Field

The present invention relates to a work machine.

Background Information

A hydraulic excavator, exemplified as a work machine, is equipped with a counterweight. When the hydraulic excavator is of a large size, the counterweight is configured to be attachable/detachable to/from a vehicle body of the hydraulic excavator to meet transportation regulations (see e.g., Japan Laid-open Patent Application Publication No. 2017-8513).

The counterweight is fastened to a rear part of the vehicle body by bolts. Amount bracket is disposed on the vehicle body to support the weight of the counterweight. There has been proposed a type of mount bracket configured to be operable not to interfere with the counterweight when the counterweight is detached from the vehicle body.

SUMMARY

However, the mount bracket is operated from the counterweight side; hence, a long-sized tool is required to be used, whereby this makes it difficult to perform the attachment/detachment work.

It is an object of the present disclosure to provide a work machine that enables a mount bracket to be easily operated in attachment/detachment of a counterweight.

A work machine according to an aspect of the present disclosure includes a vehicle body, a counterweight, a mount bracket, and an operating portion. The counterweight is attachable/detachable to/from a frame portion of a rear part of the vehicle body. The mount bracket is disposed on the frame portion to be changeable between a mounted state and a demounted state. The mount bracket is changed into the mounted state in mounting the counterweight thereto, with the counterweight being attached to the vehicle body. The mount bracket is changed into the demounted state in detachment of the counterweight from the vehicle body. The operating portion is disposed on an opposite side of the counterweight on the frame portion as seen in a back-and-forth direction of the vehicle body and is operated such that the mount bracket is changed into either the mounted state or the demounted state.

According to an aspect of the present disclosure, it is made possible to provide a work machine that enables a mount bracket to be easily operated in attachment/detachment of a counterweight.

DESCRIPTION OF EMBODIMENTS

A hydraulic excavator, exemplified as a work machine according to the present disclosure, will be hereinafter explained with reference to drawings.

Configuration (Overview of Hydraulic Excavator 1)

Figure 1:
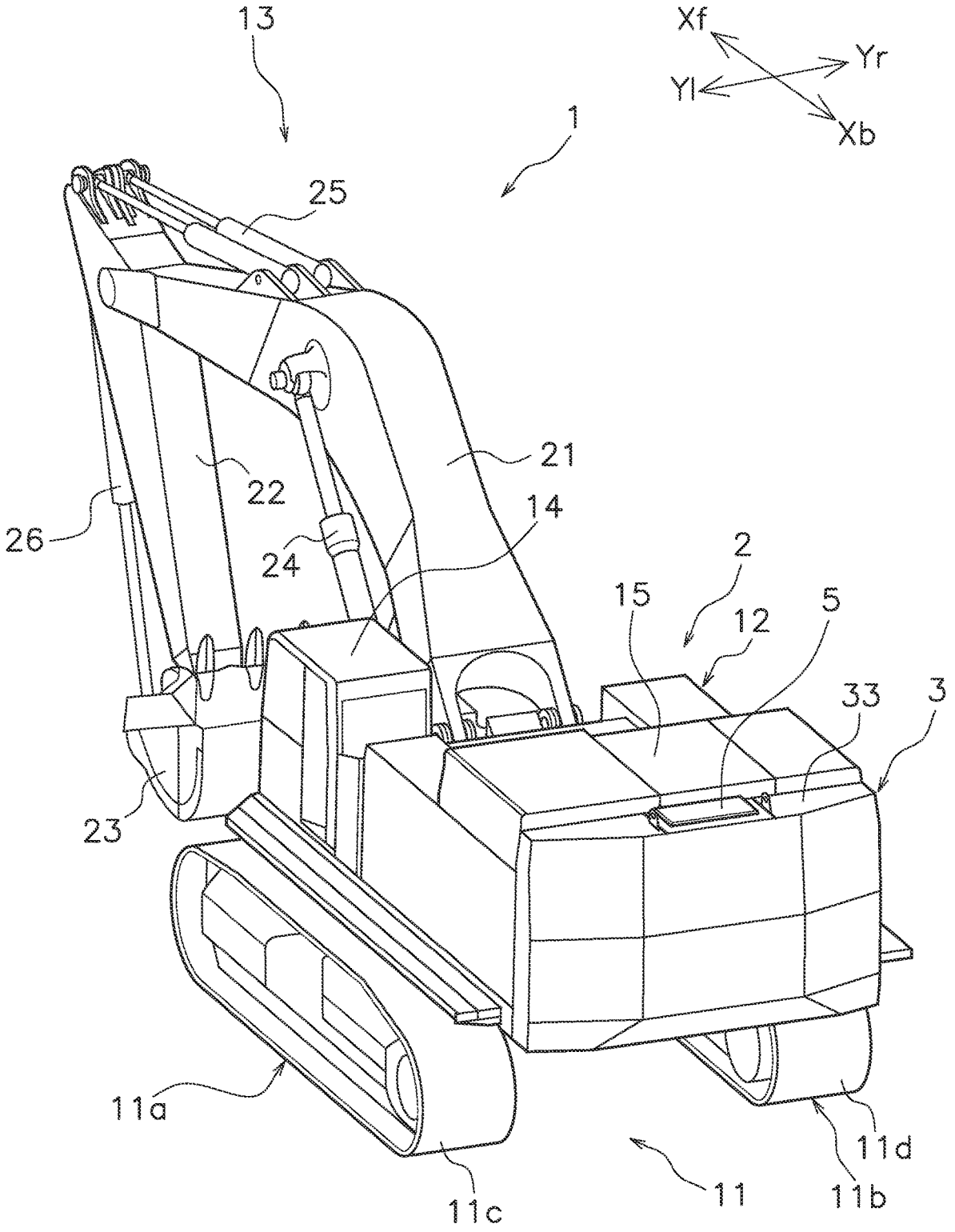
FIG. 1 is a perspective view of a hydraulic excavator according to a preferred embodiment of the present disclosure.

FIG. 1 is a schematic view of a configuration of a hydraulic excavator 1 according to the present preferred embodiment.

Figure 2:
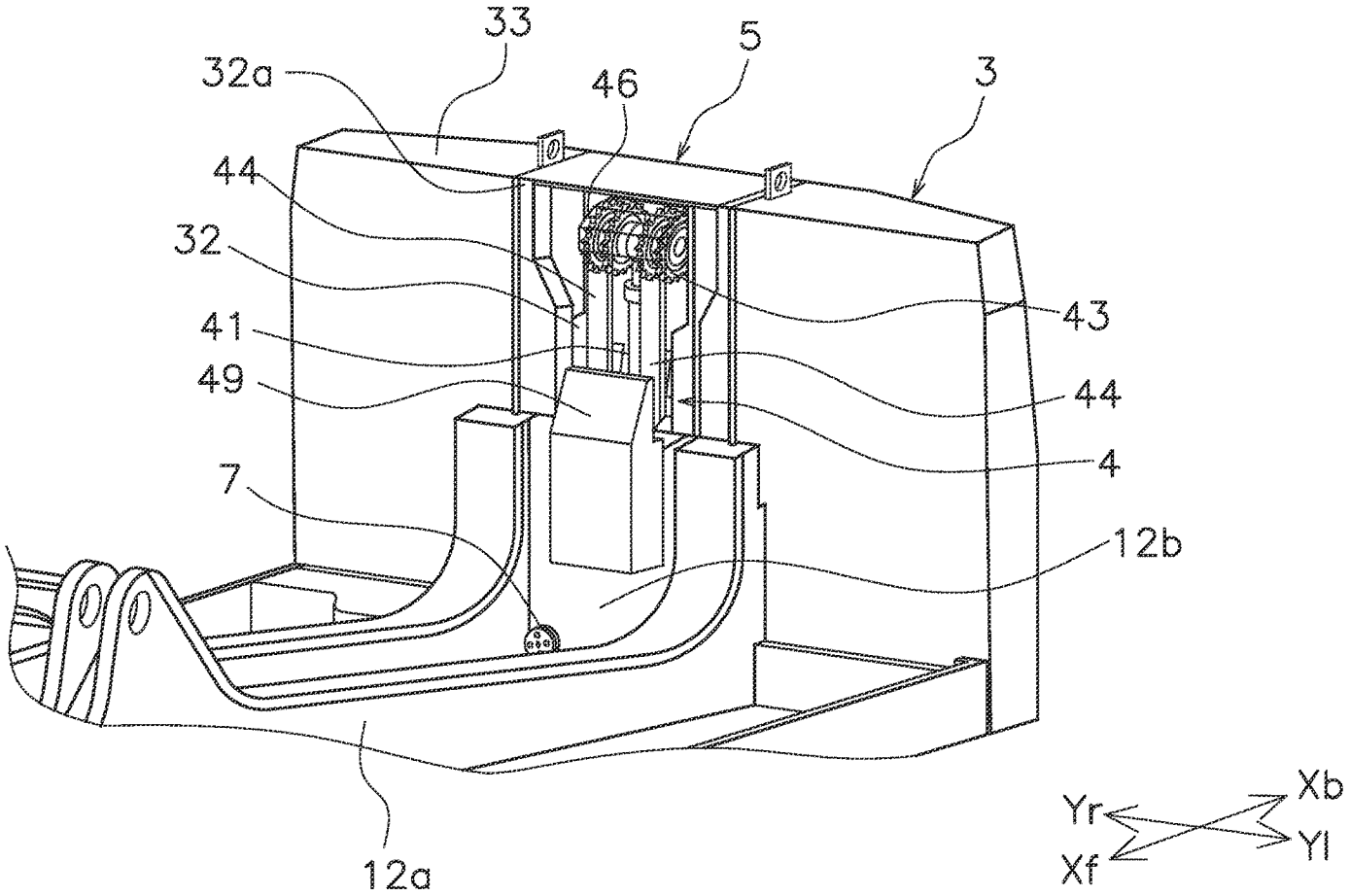
FIG. 2 is a perspective view of a frame of a revolving unit, a counterweight, and an attachment/detachment device as seen from ahead in the hydraulic excavator according to the preferred embodiment of the present disclosure.

The hydraulic excavator 1 (exemplary work machine) includes a vehicle body 2, a counterweight 3, an attachment/detachment device 4 (see FIG. 2), an upper surface cover 5, mount brackets 6 (see FIG. 3), and operating portions 7 (see FIG. 2). As shown in FIG. 1, the vehicle body 2 includes a traveling unit 11, a revolving unit 12, and a work implement 13. The traveling unit 11 includes a pair of traveling devices 11*a* and 11*b*. Each traveling device 11*a*, 11*b* includes a crawler belt 11*c*, 11*d*. When a drive motor is rotated by a drive force transmitted thereto from an engine, the crawler belts 11*c* and 11*d* are driven, whereby the hydraulic excavator 1 is caused to travel.

The revolving unit 12 is disposed on the traveling unit 11. The revolving unit 12 is configured to be enabled to revolve about an axis oriented along an up-and-down direction with respect to the traveling unit 11 by a revolving device (not shown in the drawings). A cab 14, serving as an operating room in which an operator is seated in operation, is installed in a left position on a front part of the revolving unit 12. An operator seat, levers for operating the work implement 13, a variety of display devices, and so forth are disposed in the interior of the cab 14. An engine compartment 15, in which the engine is stored, is disposed behind the cab 14.

It should be noted that in the present preferred embodiment, unless otherwise specified, directional terms "front", "rear (back)", "right", and "left" will be explained with reference to the operator seat inside the cab 14. When the operator seat faces straight forward, a direction in which the operator seat is oriented is defined as a front direction (see arrow Xf); on the other hand, a direction opposed to the front direction is defined as a rear (back) direction (see arrow Xb). When the operator seat faces straight forward, the right side and the left side in a lateral direction are defined as a right direction (see arrow Yr) and a left direction (see arrow Yl), respectively. Besides, in the present specification, unless otherwise specified, the term "up-and-down direction" indicates a direction oriented when the hydraulic excavator 1 takes a horizontal position without tilting. The front direction Xf or the rear direction Xb is exemplified as a vehicle body back-and-forth direction.

The work implement 13 is attached to a center position on the front part of the revolving unit 12. As shown in FIG. 1, the work implement 13 includes a boom 21, an arm 22, and an excavating bucket 23. The boom 21 is coupled at the base end thereof to the revolving unit 12 in a pivotable manner. Besides, the boom 21 is coupled at the distal end thereof to the base end of the arm 22 in a pivotable manner. The arm 22 is coupled at the distal end thereof to the excavating bucket 23 in a pivotable manner. The excavating bucket 23 is attached to the arm 22 such that the opening thereof is enabled to face toward the revolving unit 12 (rearward). When the excavating bucket 23 is attached in such an orientation as herein described, the hydraulic excavator 1 is referred to as a backhoe.

Hydraulic cylinders 24 to 26 (a boom cylinder 24, an arm cylinder 25, and a bucket cylinder 26) are disposed in one-to-one correspondence to the boom 21, the arm 22, and the excavating bucket 23. When the hydraulic cylinders 24 to 26 are driven, the work implement 13 is driven. Accordingly, such a work as excavation is performed.

The counterweight 3 is attached to the rear side of the vehicle body 2. The counterweight 3 is attachable/detachable to/from the vehicle body 2. The attachment/detachment device 4 mounts/demounts the counterweight 3 to/from the vehicle body 2, although this will be explained below in detail.

(Counterweight 3)

Figure 3:
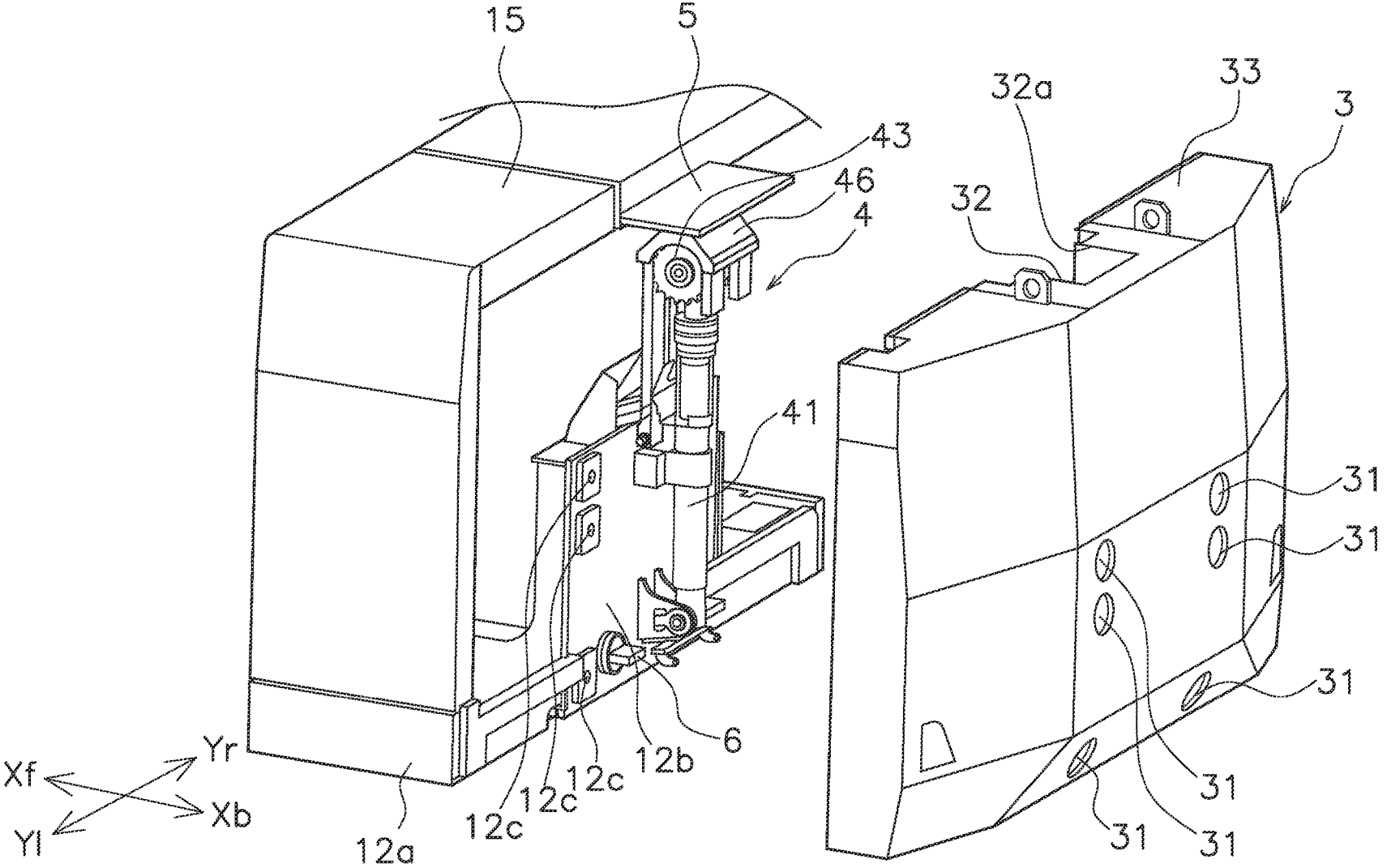
FIG. 3 is a perspective view of a condition made when the counterweight is separated from the frame of the revolving unit in the hydraulic excavator according to the preferred embodiment of the present disclosure.
Figure 4:
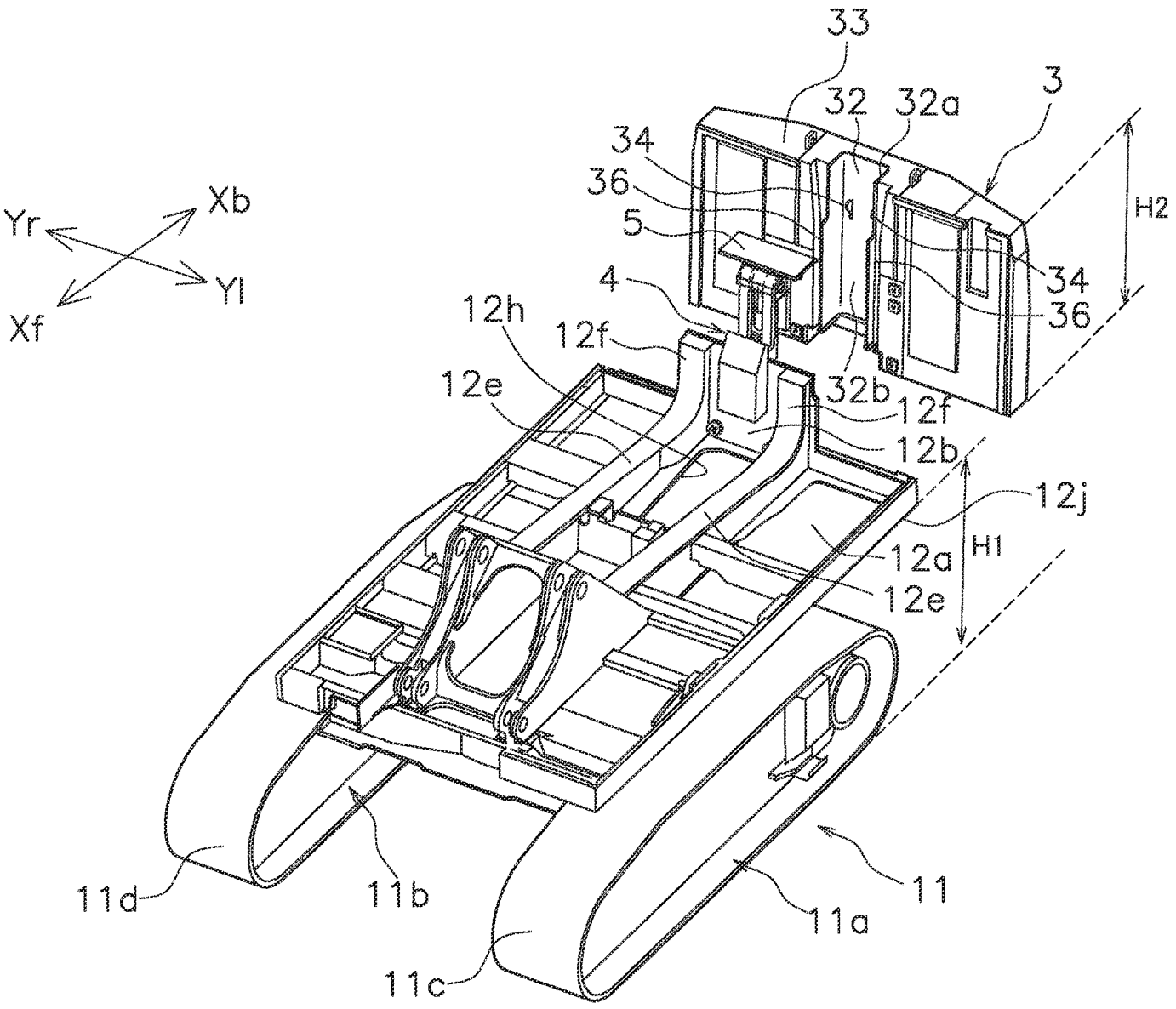
FIG. 4 is a perspective view of a condition made when the counterweight is separated from the frame of the revolving unit in the hydraulic excavator according to the preferred embodiment of the present disclosure.
Figure 5A:
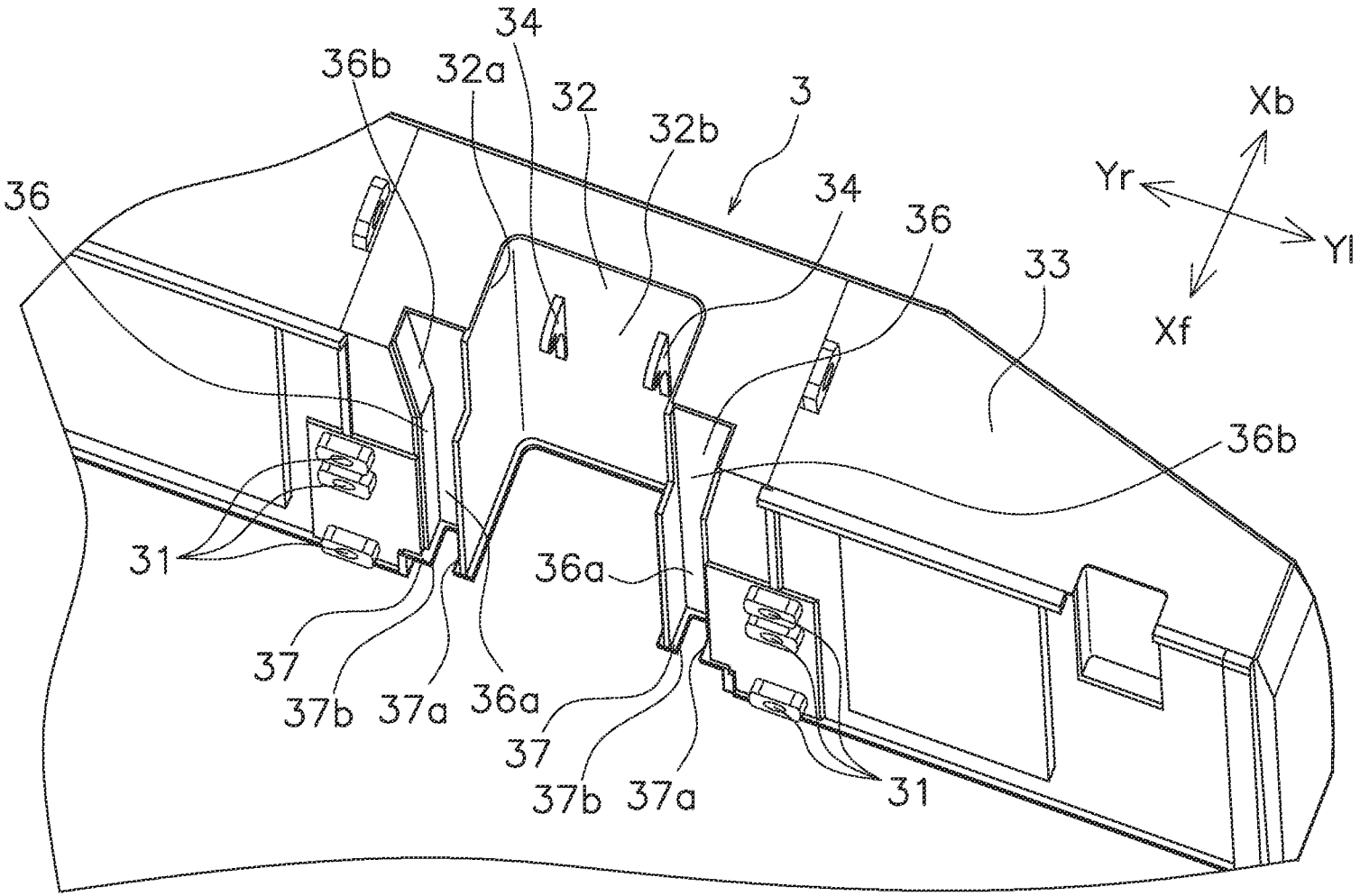
FIG. 5A is a perspective view of the counterweight for the hydraulic excavator according to the preferred embodiment of the present disclosure as seen from above.
Figure 5B:
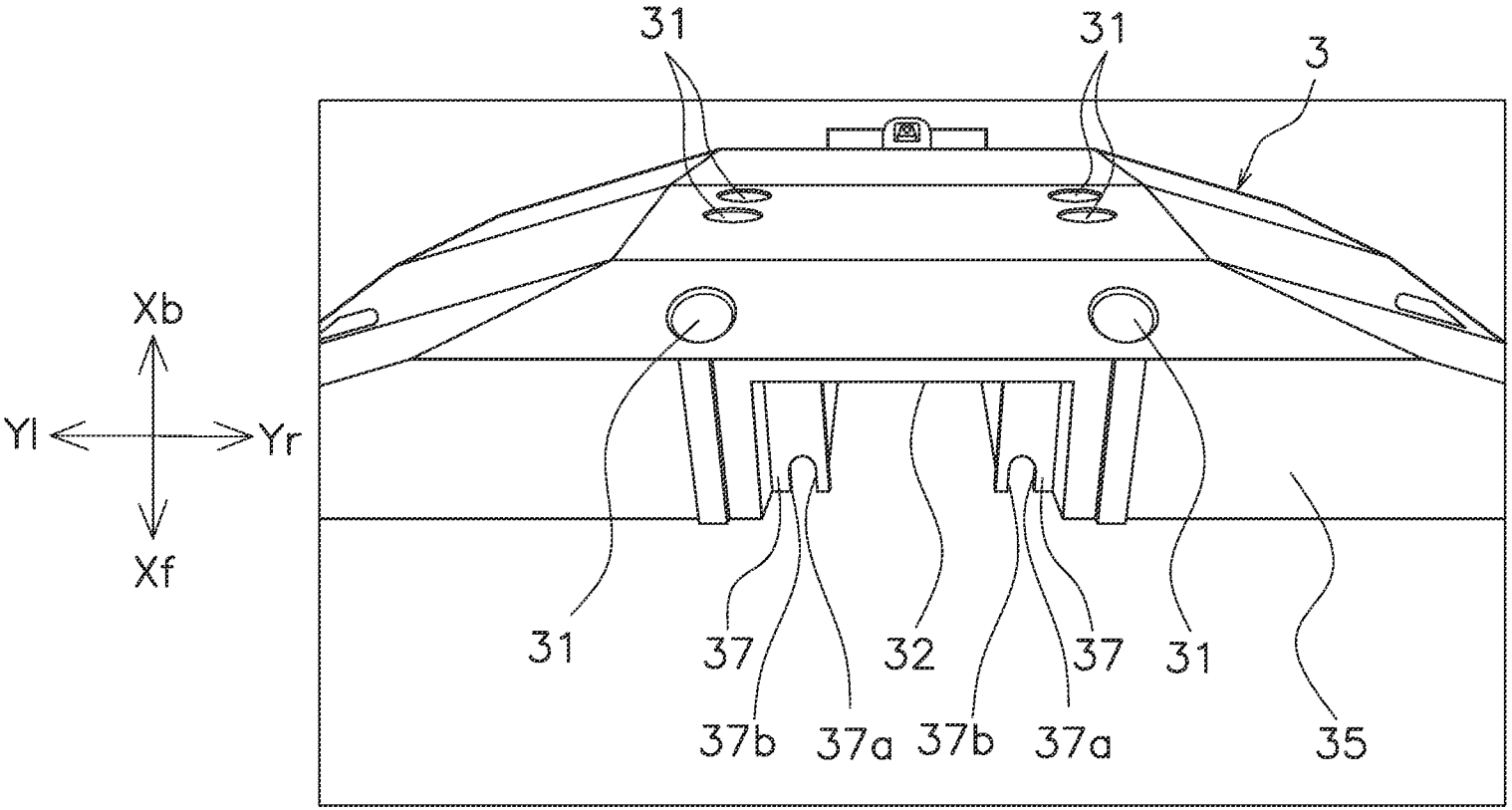
FIG. 5B is a perspective view of the counterweight for the hydraulic excavator according to the preferred embodiment of the present disclosure as seen from below.

FIG. 2 is a perspective view of a frame 12*a* of the revolving unit 12, the counterweight 3, and the attachment/detachment device 4 as seen from ahead. FIG. 3 is a perspective view of a condition made when the counterweight 3 is separated from the frame 12*a* of the revolving unit 12 as seen from left rear. FIG. 4 is a perspective view of a condition made when the counterweight 3 is separated from the frame 12*a* as seen from front above. FIG. 5A is a perspective view of the counterweight 3 as seen from above. FIG. 5B is a perspective view of the counterweight 3 as seen from below.

The counterweight 3 is attached to a frame portion 12*b* disposed in a rear part of the frame 12*a* of the revolving unit 12. The frame portion 12*b* is a plate-shaped portion extending perpendicular to the back-and-forth direction.

As shown in FIG. 4, the frame 12*a* of the revolving unit 12 includes main beams 12*e* disposed in alignment in the right-and-left direction. Each main beam 12*e* is disposed along the back-and-forth direction. Each main beam 12*e* includes a raised portion 12*f*. The raised portion 12*f* is a portion raised upward in a rear portion of each main beam 12*e*. The frame portion 12*b* is attached to the rear sides of the raised portions 12*f* of the pair of main beams 12*e*.

As shown in FIG. 3, the counterweight 3 is provided with a plurality of through holes 31 penetrating therethrough in the back-and-forth direction. As shown in FIG. 3, in the present preferred embodiment, the counterweight 3 is provided with six through holes 31. The six through holes 31 are composed of two sets of through holes 31 aligned in the right-and-left direction; besides, each set of through holes 31 is composed of three through holes 31 aligned along the up-and-down direction. The frame portion 12*b* is provided with holes 12*c*, into which bolts are inserted, in one-to-one corresponding positions to the through holes 31. The bolts are inserted from behind into the insertion holes 12*c* via the through holes 31, whereby the counterweight 3 is fixed to the frame portion 12*b*. It should be noted that only three of the insertion holes 12*c*, disposed on the left lateral surface side, are shown in FIG. 3, whereas the remaining three of the insertion holes 12*c*, disposed on the right lateral surface side, are hidden by the attachment/detachment device 4 and hence are not shown in FIG. 3.

As shown in FIG. 4, the counterweight 3 is provided with a recessed portion 32 (exemplary storage portion) along the up-and-down direction. Due to the recessed portion 32, a cutout-shaped portion is formed in the counterweight 3. As shown in FIG. 2, while the counterweight 3 is attached to the vehicle body 2, the attachment/detachment device 4 is disposed in the recessed portion 32. As shown in FIGS. 5A and 5B, the recessed portion 32 is shaped to extend from an upper surface 33 to a lower surface 35 in the counterweight 3. As shown in FIG. 5A, the upper surface 33 is provided with an opening 32*a* due to the recessed portion 32. The opening 32*a* is closed by the upper surface cover 5.

Besides, as shown in FIG. 5A, two brackets 34, each of which is made in shape of a plate extending along the up-and-down direction, are disposed on a surface portion 32*b* corresponding to the rearmost portion of the recessed portion 32 among the front-side surface of the counterweight 3. Chains 44 (to be described) are connected at end portions 44*b* thereof to the brackets 34, respectively.

As shown in FIG. 5A, the counterweight 3 is provided with groove portions 36 on both sides of the recessed portion 32 in the right-and-left direction. As shown in FIGS. 5A and 5B, each groove portion 36 is provided in adjacent to the recessed portion 32.

As shown in FIG. 5A, each groove portion 36 includes a first section 36*a*, which is constant in right-and-left directional width, and a second section 36*b*, which continues to the first section 36*a* on the upper side of the first section 36*a*. The second section 36*b* is shaped such that the right-and-left directional width thereof is gradually widened upward.

As shown in FIGS. 5A and 5B, a contact portion 37 (exemplary surrounding portion of the lower end of a groove portion), having a plate shape, is disposed on the lower end of the first section 36*a* of each groove portion 36. The contact portion 37 is provided with a cutout 37*a* The cutout 37*a* is provided on the lower side of each groove portion 36. As shown in FIG. 5A, the cutout 37*a* includes an opened section 37*b* on the front end of the contact portion 37 and is cut out rearward from the front end of the contact portion 37. The cutout 37*a* is shaped to be slightly smaller in width than the first section 36*a*. In the state of the counterweight 3 attached to the vehicle body 2, the mount brackets 6 are in contact with the contact portions 37, respectively, although this will be described below in detail.

(Attachment/Detachment Device 4)

As shown in FIG. 2, the attachment/detachment device 4 is disposed on the rear side of the vehicle body 2. The upper surface cover 5 is disposed on the upper side of the attachment/detachment device 4.

Figure 6:
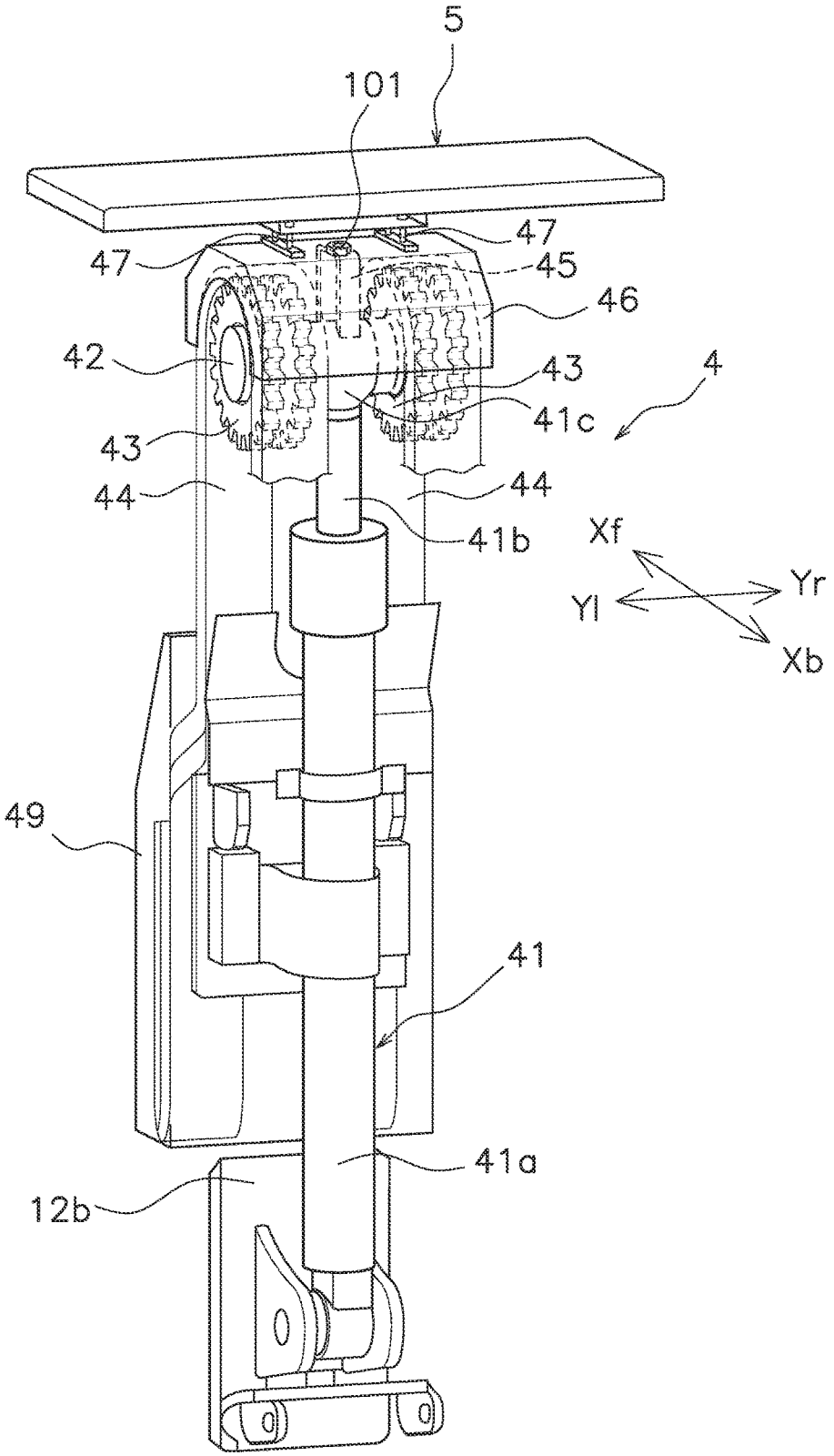
FIG. 6 is a perspective view of the attachment/detachment device and an upper surface cover in the hydraulic excavator according to the preferred embodiment of the present disclosure.

FIG. 6 is a perspective view of the attachment/detachment device 4.

As shown in FIG. 6, the attachment/detachment device 4 includes a cylinder 41, a shaft member 42, sprockets 43, the chains 44, a support base 45, and a sprocket cover 46.

As shown in FIG. 3, the cylinder 41 is attached to the frame portion 12*b* of the rear part of the revolving unit 12. The frame portion 12*b* is a portion made in shape of a plate extending perpendicular to the back-and-forth direction. The cylinder 41 is fixed to the rear surface of the frame portion 12*b*. The cylinder 41 is disposed along the up-and-down direction.

When described in detail, as shown in FIG. 6, the cylinder 41 includes a cylinder tube 41*a* and a cylinder rod 41*b*. The cylinder tube 41*a* is disposed along the up-and-down direction. The cylinder tube 41*a* is fixed to the rear surface of the frame portion 12*b*. A piston (not shown in the drawings) is disposed on the lower end of the cylinder rod 41*b*. The piston is disposed to be movable within the cylinder tube 41*a*. The upper end of the cylinder rod 41*b* protrudes upward from the cylinder tube 41*a*. The internal space of the cylinder tube 41*a* is divided into a bottom-side space and a rod-side space by the piston.

Figure 7:
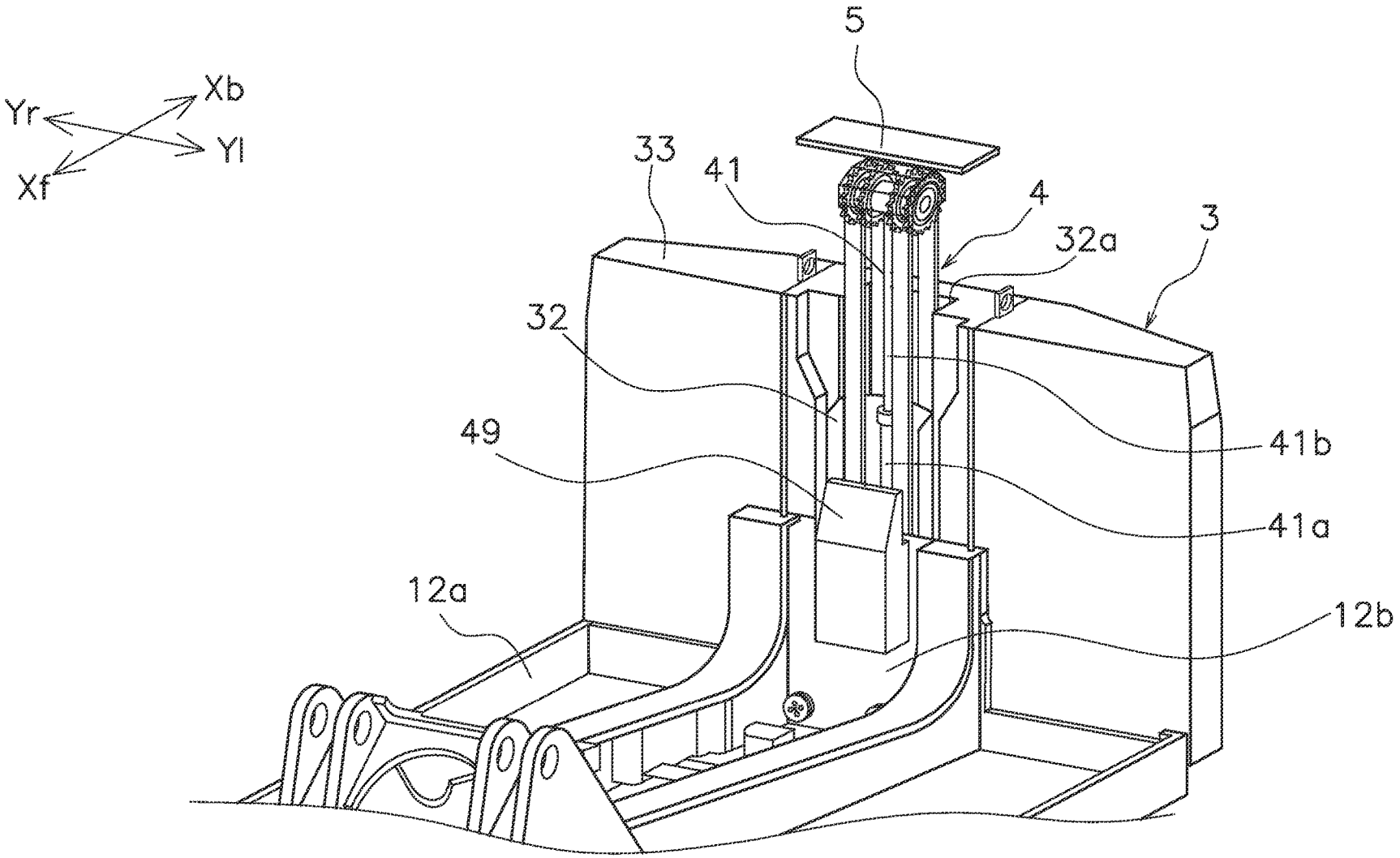
FIG. 7 is a perspective view of a cylinder expanded from the state thereof shown in FIG. 2.

FIG. 7 is a view of the cylinder 41 expanded from the state thereof shown in FIG. 2. When hydraulic oil is supplied to the bottom-side space of the cylinder tube 41*a* by a pump (not shown in the drawings), while the hydraulic oil, contained in the rod-space of the cylinder tube 41*a*, is discharged therefrom, the cylinder rod 41*b* is moved upward with respect to the cylinder tube 41*a*. Accordingly, the cylinder 41 is expanded as shown in FIG. 7.

Contrarily, when the hydraulic oil, contained in the bottom-side space of the cylinder tube 41*a*, is discharged therefrom, while the hydraulic oil is supplied to the rod-side space of the cylinder tube 41*a*, the cylinder rod 41*b* is moved downward with respect to the cylinder tube 41*a*. Accordingly, the cylinder 41 is contracted as shown in FIG. 2.

As shown in FIG. 6, the shaft member 42 is fixed to a distal end 41*c* of the cylinder rod 41*b*. The shaft member 42 is disposed along the right-and-left direction. The shaft member 42 protrudes leftward from the distal end 41*c*, while protruding rightward therefrom.

As shown in FIG. 6, the sprockets 43 are disposed on both right and left sides of the distal end 41*c* of the cylinder rod 41*b*. The sprockets 43 are disposed to be rotatable on the shaft member 42. It should be noted that in the present preferred embodiment, each sprocket 43 is provided with a through hole along the right-and-left direction; besides, the shaft member 42 is inserted into the through hole. When each sprocket 43 is rotated with respect to the shaft member 42, the outer peripheral surface of the shaft member 42 and the inner peripheral surface of the through hole of each sprocket 43 slide against each other.

The chains 44 are wound about the sprockets 43, respectively. The chains 44 are connected to the revolving unit 12 and the counterweight 3. The sprockets 43 are disposed on both sides of the distal end 41*c* of the cylinder rod 41*b* in the right-and-left direction; hence, the chains 44 are disposed on both right and left sides of the distal end 41*c* of the cylinder rod 41*b* as well.

Figure 8:
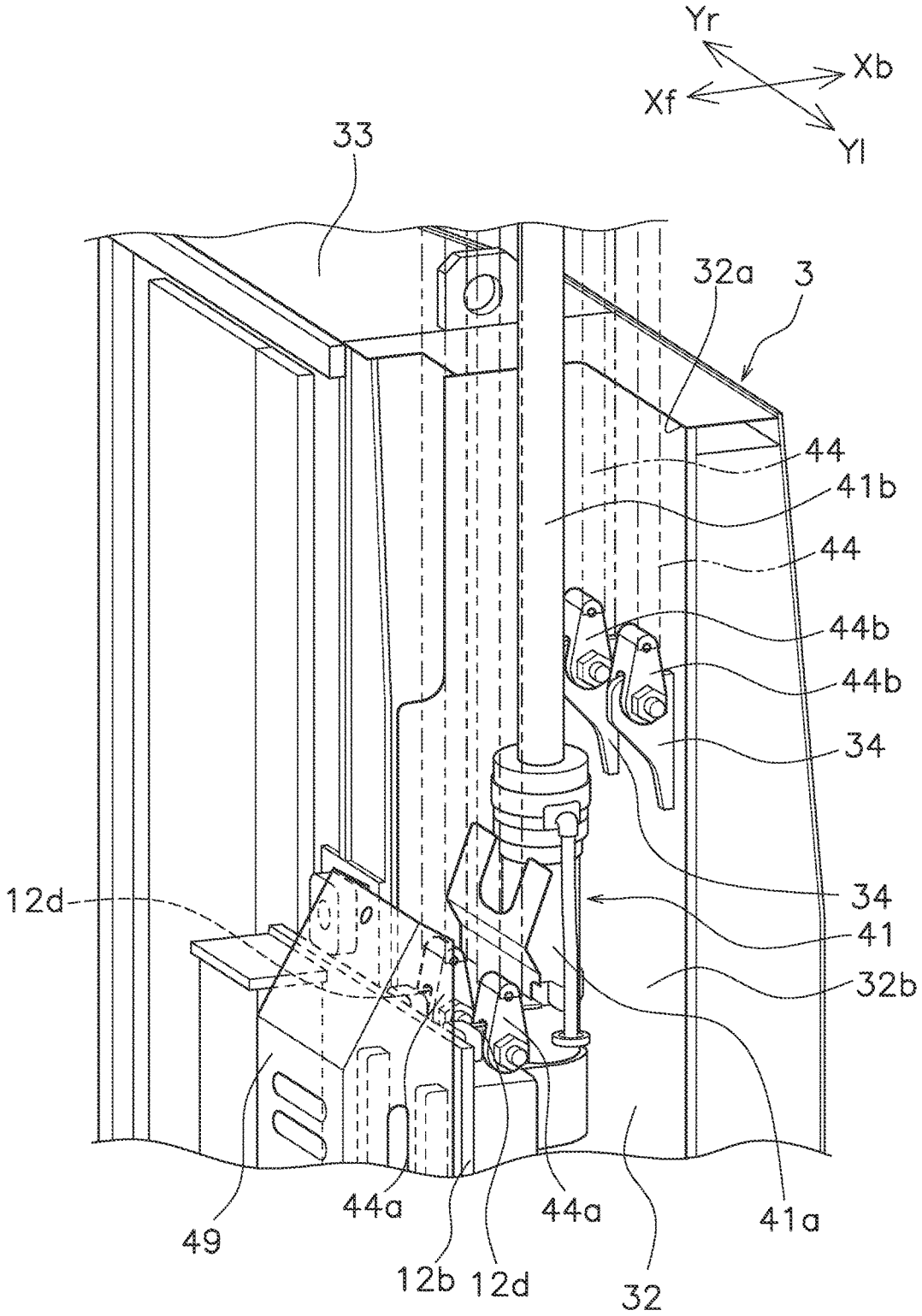
FIG. 8 is a perspective view for explaining connection of chains to the revolving unit and the counterweight in the hydraulic excavator according to the present preferred embodiment of the present disclosure.

FIG. 8 is a perspective view for explaining connection of the chains 44 to the revolving unit 12 and the counterweight 3. FIG. 8 shows an expanded state of the cylinder 41 to make both ends of the chains 44 visible as much as possible. Besides, FIG. 8 shows structures on the deep side of the paper surface of the chains 44. Also, the chains 44 are depicted with dashed two-dotted line in FIG. 8.

Each of the right and left chains 44 is connected at one end portion 44*a* to the frame portion 12*b*. Two brackets 12*d* are disposed on the rear-side surface of the frame portion 12*b*. Each bracket 12*d* includes a plate-shaped portion protruding rearward; besides, the plate-shaped portion is disposed along the up-and-down direction. The end portion 44*a* of each chain 44 is attached to the plate-shaped portion of each bracket 12*d* to be pivotable about an axis oriented along the right-and-left direction.

Each chain 44 is connected at the other end portion 44*b* thereof to the front-side surface of the counterweight 3. The end portion 44*b* of each chain 44 is attached to each bracket 34 disposed on the surface portion 32*b* described above to be pivotable about an axis oriented along the right-and-left direction.

As shown in FIG. 6, the support base 45 is fixed to the distal end 41*c* of the cylinder 41. The support base 45 is disposed on the upper side of the distal end 41*c*. The support base 45 is provided for supporting the sprocket cover 46.

The sprocket cover 46 is disposed to cover the sprockets 43 from above. As shown in FIG. 6, the sprocket cover 46 is fixed to the support base 45 from the upper side thereof by a bolt 101.

Shoulder bolts 47 are disposed on the upper side of the sprocket cover 46. For example, four shoulder bolts 47 are disposed. Each shoulder bolt 47 is disposed along the up-and-down direction. The upper surface cover 5 is disposed on the upper side of the four shoulder bolts 47.

(Upper Surface Cover 5)

As described above, the upper surface cover 5 is disposed on the upper side of the attachment/detachment device 4. The upper surface cover 5 is moved in the up-and-down direction in accordance with expansion and contraction of the cylinder 41. As shown in FIGS. 2 and 7, when the cylinder 41 is contracted, the upper surface cover 5 is contacted to the upper surface 33 of the counterweight 3, whereby the opening 32*a* of the recessed portion 32 is closed.

(Mount Brackets 6)

Figure 9:
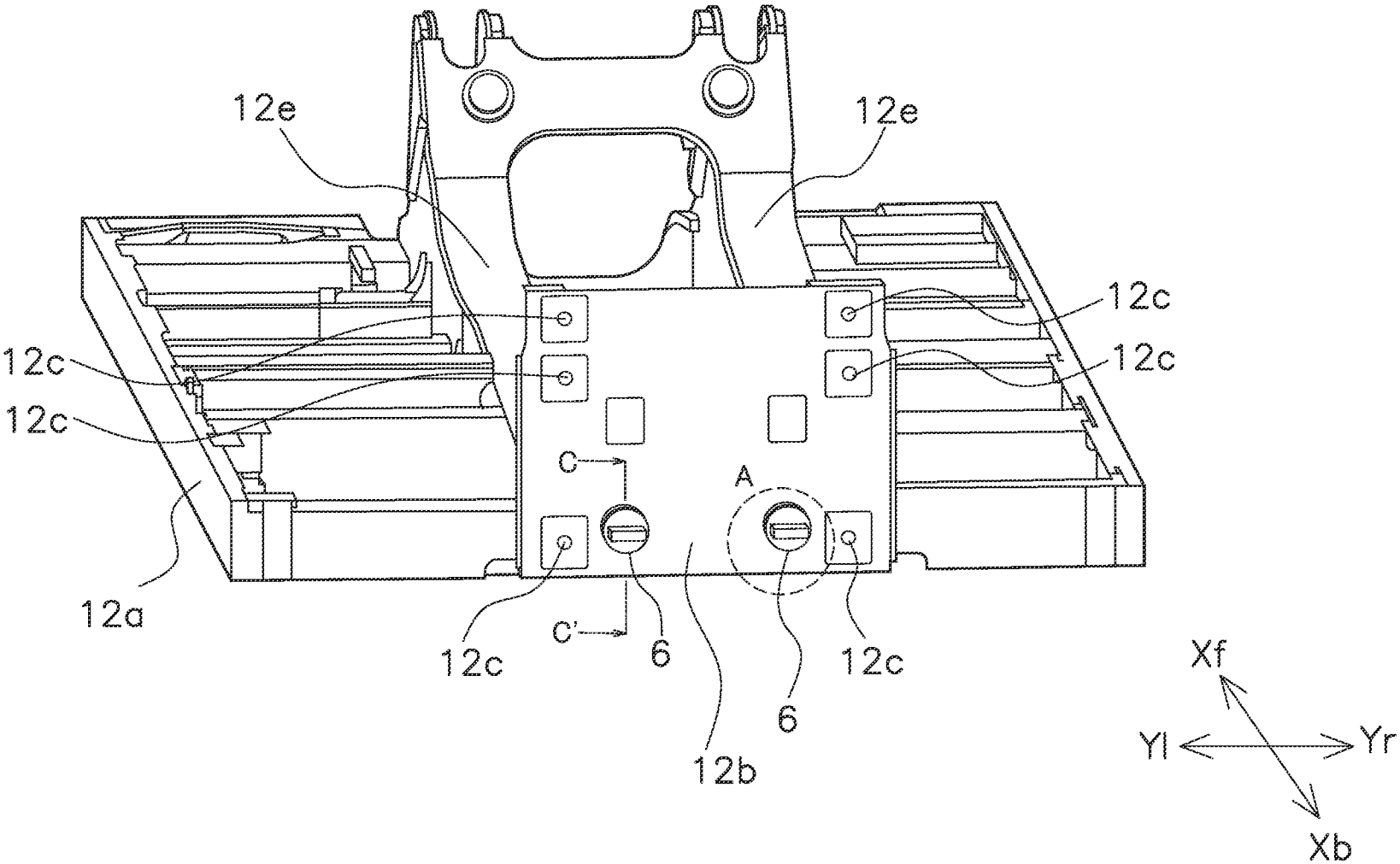
FIG. 9 is a perspective view of the frame of the revolving unit as seen from behind in the hydraulic excavator according to the present preferred embodiment of the present disclosure.

FIG. 9 is a perspective view of the frame 12*a* of the revolving unit 12 as seen from behind. In the present preferred embodiment, as shown in FIG. 9, two mount brackets 6 are disposed on the frame portion 12*b* of the frame 12*a*. The two mount brackets 6 are disposed on a lower part of the frame portion 12*b*. The two mount brackets 6 are disposed in alignment in the right-and-left direction.

Figure 10B:
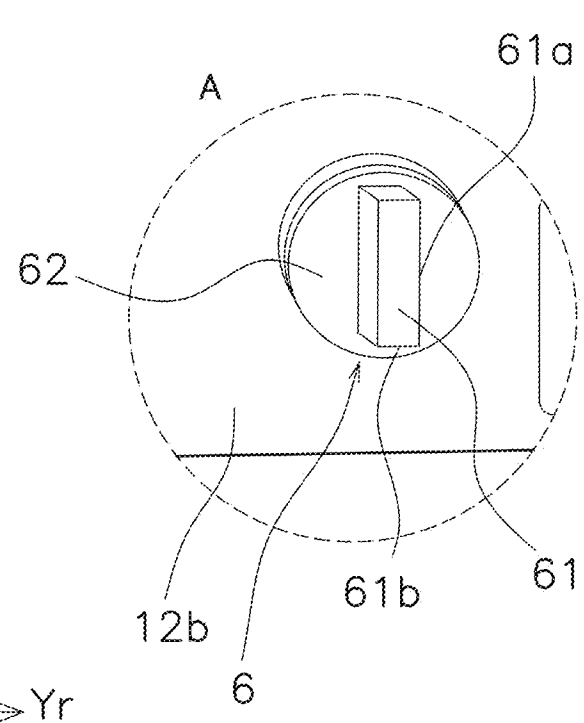
FIG. 10B is a view of a mount bracket set in a demounted state when turned in a direction of arrow B in FIG. 10A.
Figure 10A:
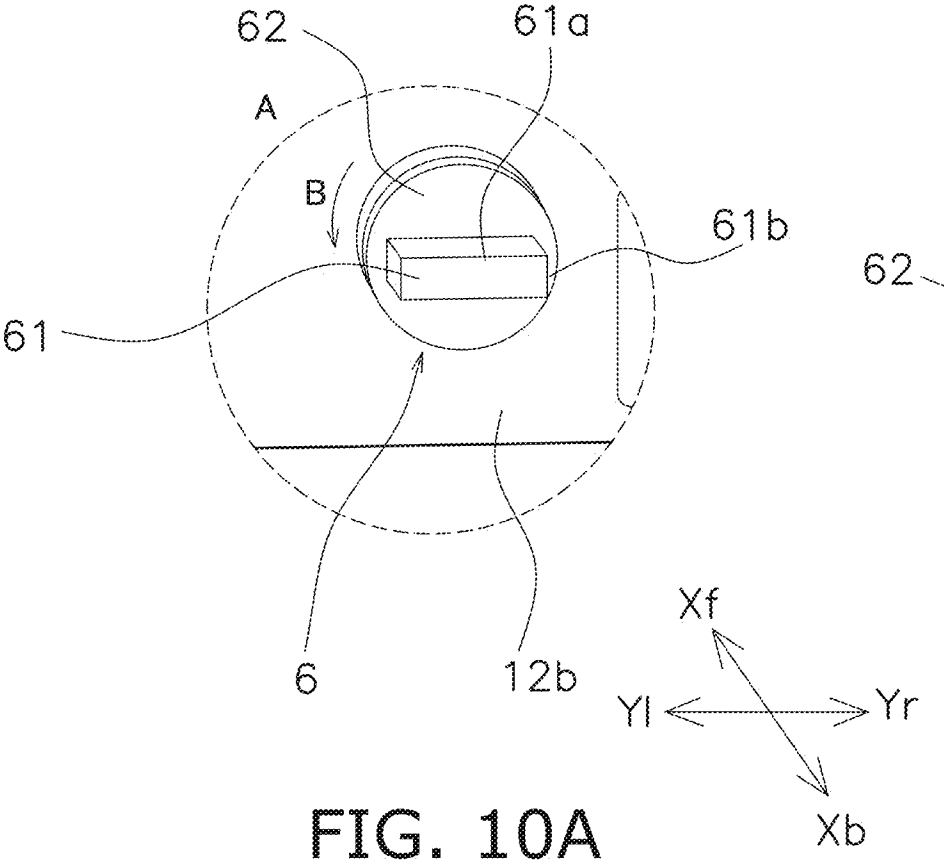
FIG. 10A is a close-up view of region A shown in FIG. 9

FIG. 10A is a close-up view of region A shown in FIG. 9. Each mount bracket 6 is attached to the frame portion 12*b*, while being turnable about an axis A oriented along the back-and-forth direction (see arrow B as to the turn direction). When turned, each mount bracket 6 is enabled to take a mounted state in mounting the counterweight 3 thereto and is also enabled to take a demounted state in detachment of the counterweight 3. FIG. 10A shows the mounted state of each mount bracket 6. FIG. 10B shows the demounted state of each mount bracket 6 made when each mount bracket 6 is turned in the direction indicated by arrow B in FIG. 10A.

Figure 11:
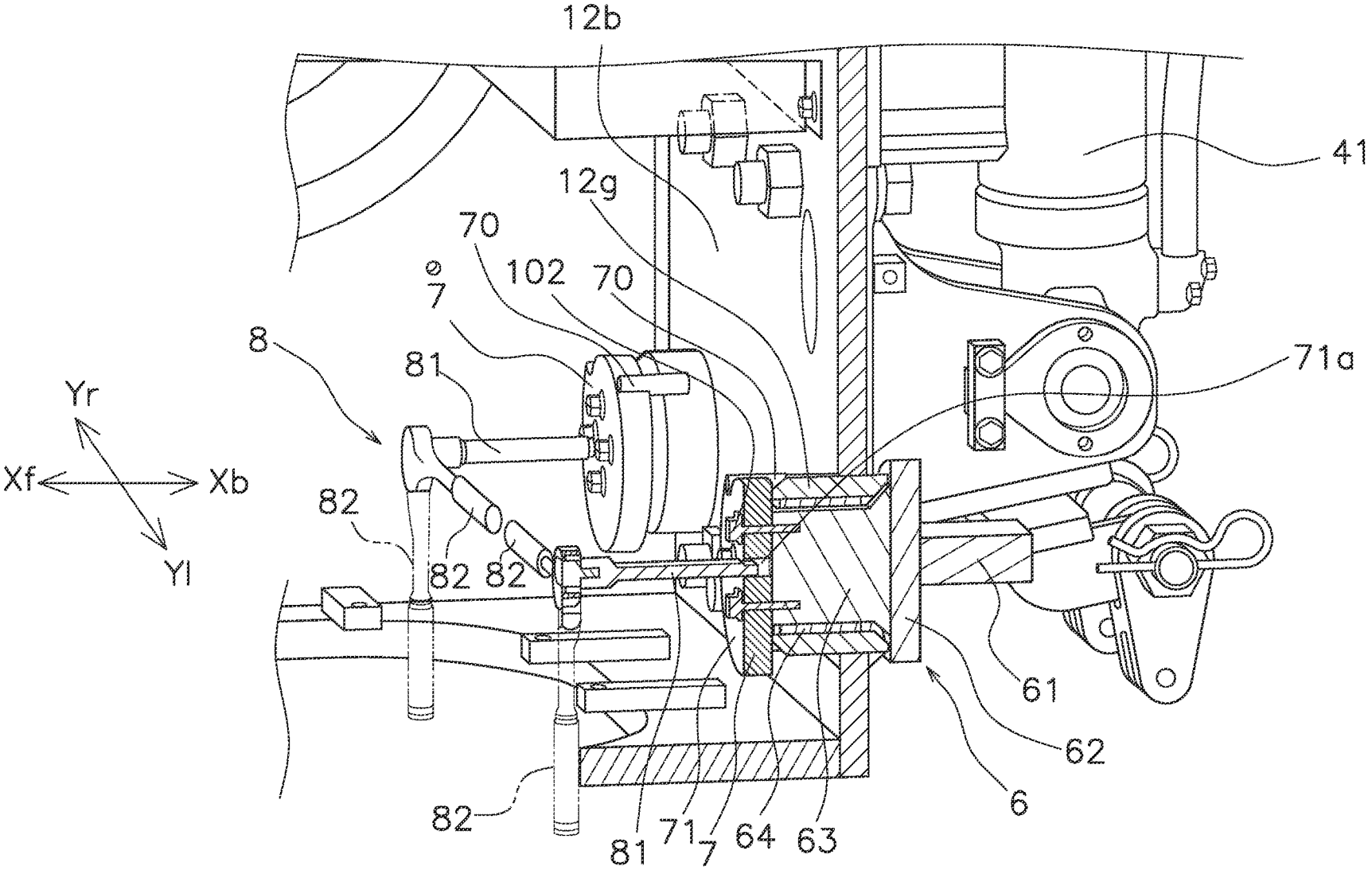
FIG. 11 is a cross-sectional view including a cross section taken along arrow line CC' in FIG. 9.

FIG. 11 is a cross-sectional view including a cross section taken along arrow line CC' in FIG. 9. Each mount bracket 6 includes amounted portion 61, a disc-shaped portion 62, and a shaft portion 63.

As shown in FIGS. 10A and 10B, the mounted portion 61 has an approximately rectangular parallelepiped shape. As shown in FIG. 10A, the mounted portion 61 has a rectangular shape as seen from behind, and hence, has a lengthwise direction and a crosswise direction. The mounted portion 61 includes a long side 61*a* disposed along the lengthwise direction and a short side 61*b* disposed along the crosswise direction. When each mount bracket 6 is set in the mounted state, the long side 61*a* of the mounted portion 61 is disposed along the right-and-left direction, whereas the short side 61*b* thereof is disposed along the up-and-down direction. By contrast, as shown in FIG. 10B, when each mount bracket 6 is set in the demounted state, the long side 61*a* of the mounted portion 61 is disposed along the up-and-down direction, whereas the short side 61*b* thereof is disposed along the right-and-left direction.

The disc-shaped portion 62 is a disc-shaped portion composing part of each mount bracket 6. The disc-shaped portion 62 is disposed such that the center axis thereof is oriented along the back-and-forth direction. The disc-shaped portion 62 is disposed on the rear side of the frame portion 12*b*. The disc-shaped portion 62 is disposed on the front side of the mounted portion 61 and continues to a front-side part of the mounted portion 61. The mounted portion 61 is disposed along the diameter of the disc-shaped portion 62.

As shown in FIG. 11, the shaft portion 63 is mounted to the frame portion 12*b* in a turnable manner. The shaft portion 63 has a columnar shape and continues to a front-side part of the disc-shaped portion 62. The shaft portion 63 is disposed along the back-and-forth direction. The front portion 12*b* is penetrated by a tubular portion 12*g* in the back-and-forth direction. The shaft portion 63 is inserted into the tubular portion 12*g* in a turnable manner. The shaft portion 63 continues at the rear end thereof to the disc-shaped portion 62, while being connected at the front end thereof to each operating portion 7 to be described. A bushing 64 is disposed about the shaft portion 63. The bushing 64 is provided with one or more grease grooves on the inner surface thereof to enable refilling of grease.

Figure 12A:
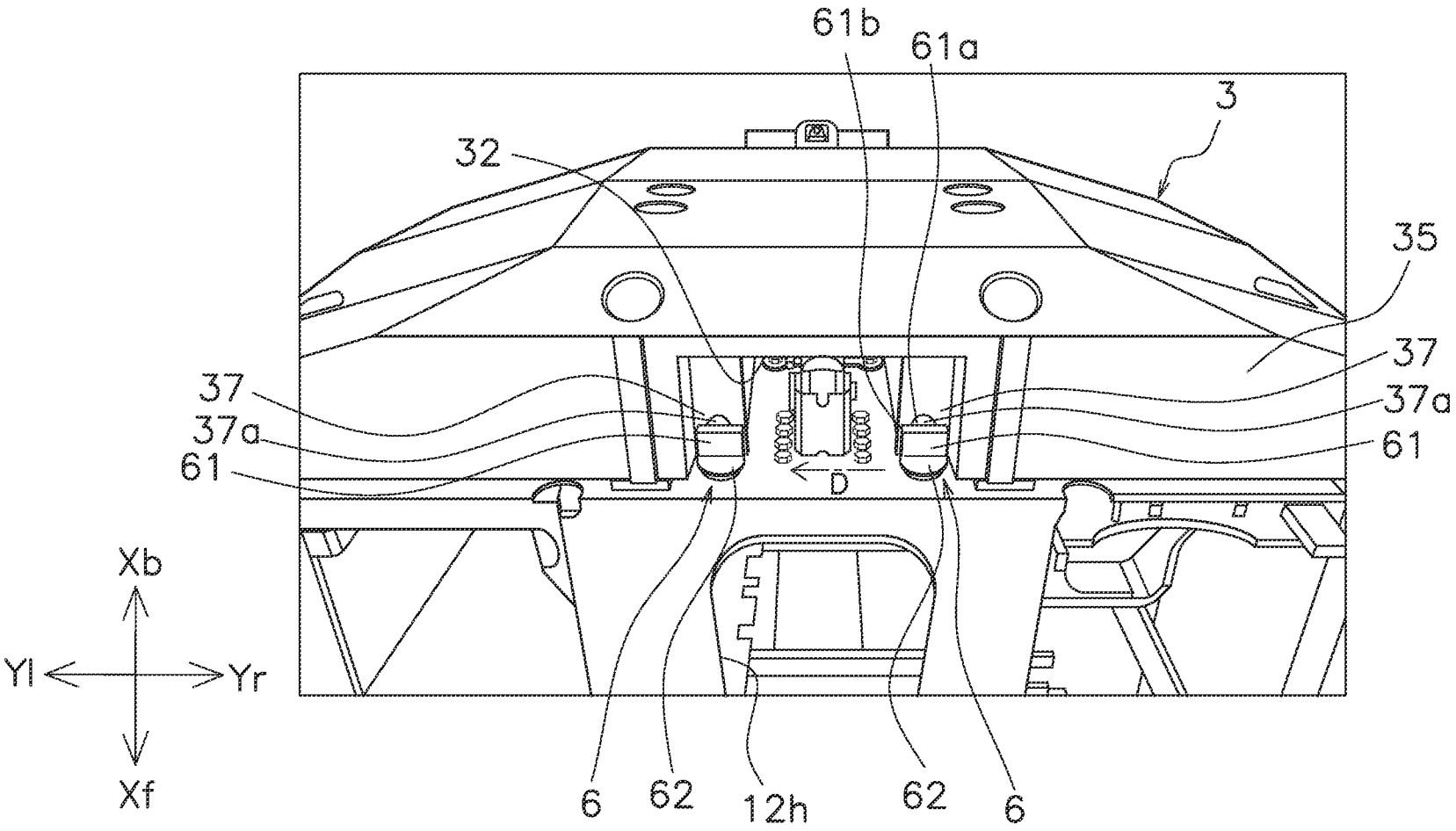
FIG. 12A is a view of a condition made when the counterweight is attached to a vehicle body as seen from below in the hydraulic excavator according to the present preferred embodiment of the present disclosure.
Figure 12B:
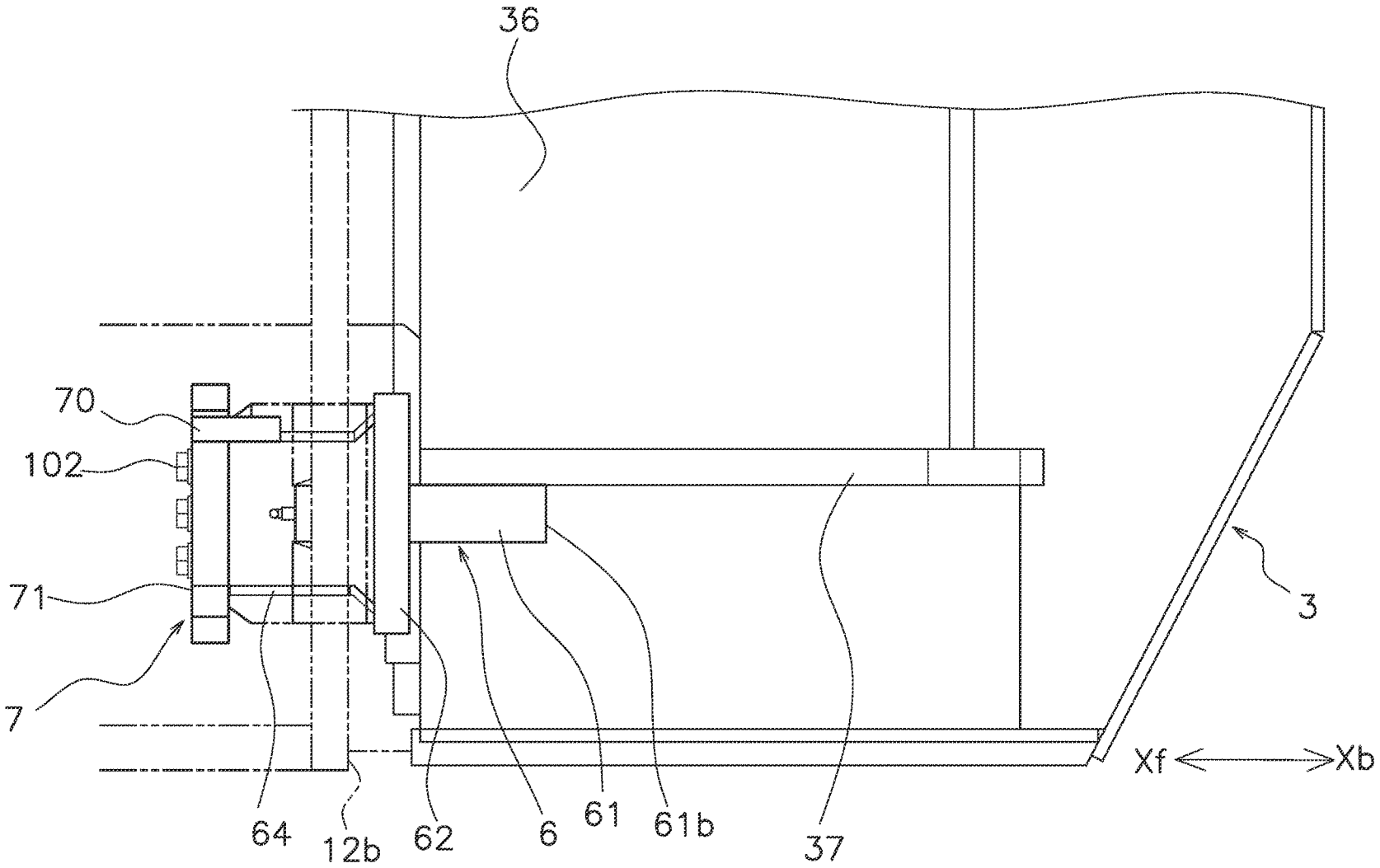
FIG. 12B is a cross-sectional view of FIG. 12A taken along arrow D.
Figure 12C:
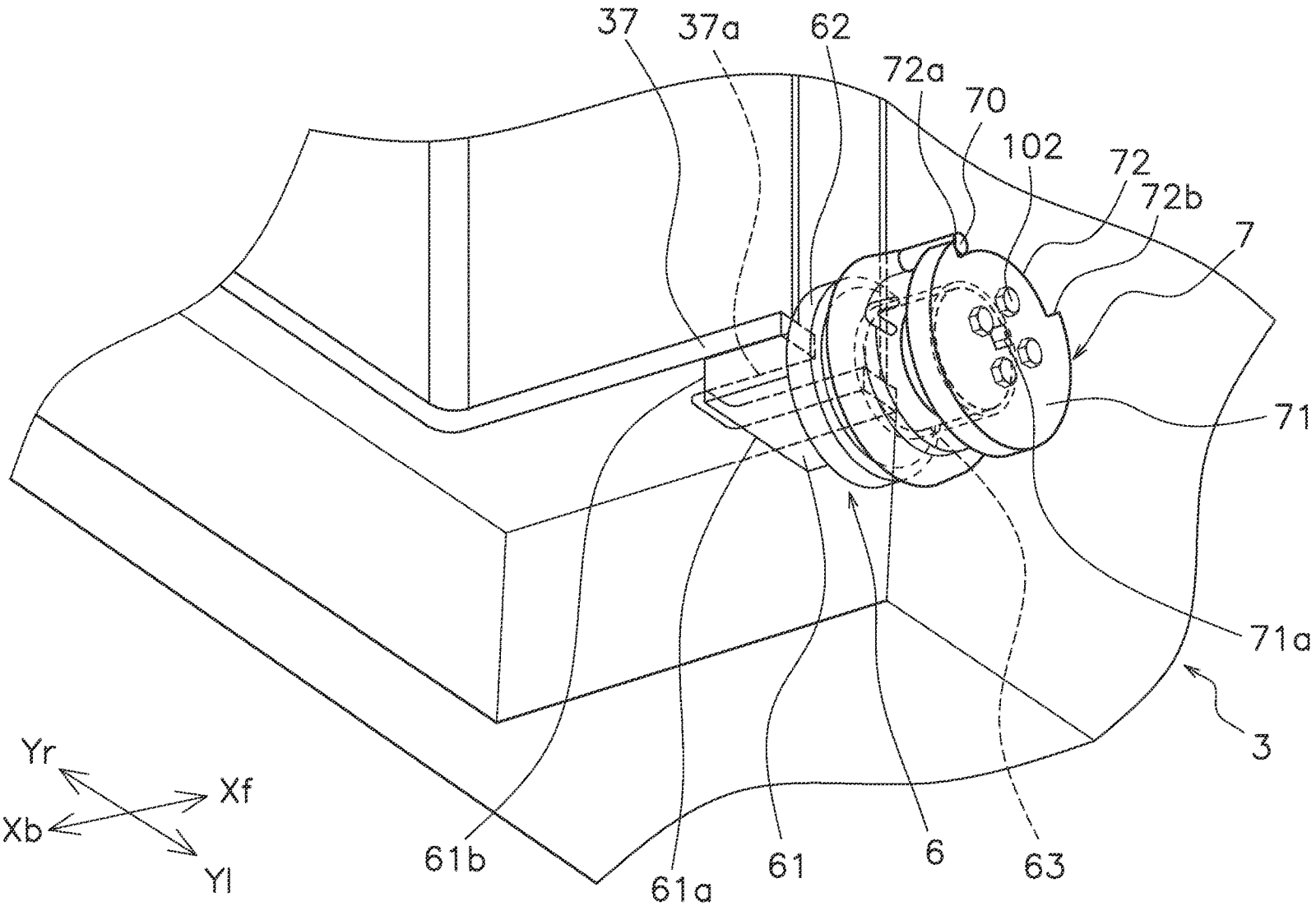
FIG. 12C is a perspective view of a laterally left side mount bracket and the vicinity thereof as seen from ahead in FIG. 12A.
Figure 12D:
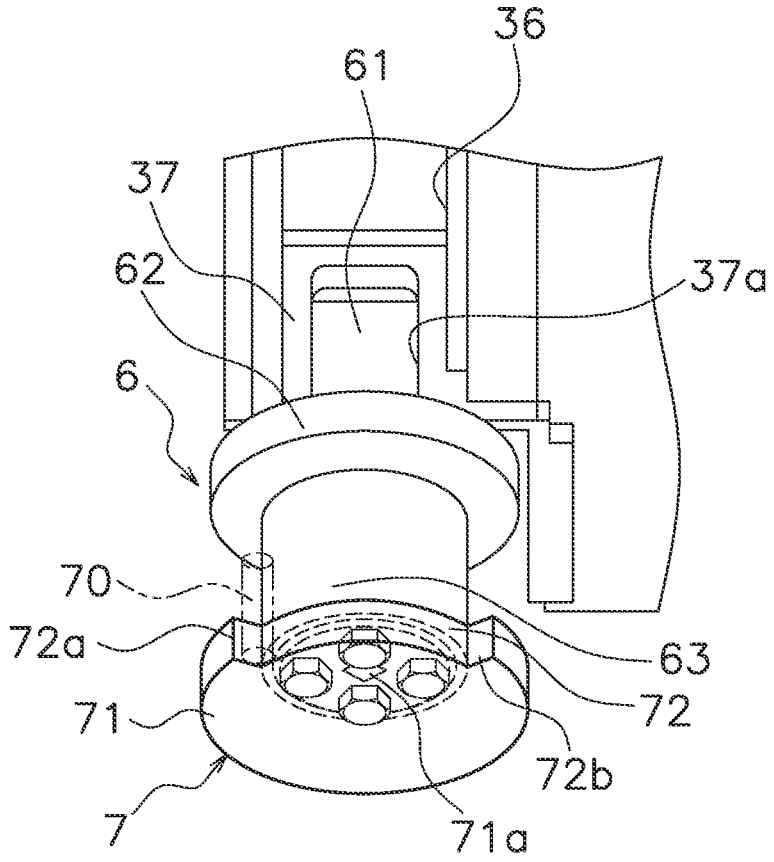
FIG. 12D is a perspective view of the laterally left side mount bracket and the vicinity thereof as seen from front above in FIG. 12A.
Figure 12D:
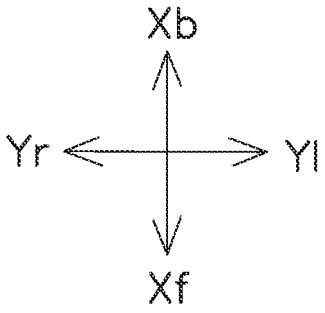

FIG. 12A is a view of a condition made when the counterweight 3 is attached to the vehicle body 2 as seen from below FIG. 12B is a cross-sectional view taken along arrow D in FIG. 12A. In FIG. 12B, the frame portion 12*b* is depicted with dashed two-dotted line, whereas components hidden by the frame portion 12*b* are depicted with solid line. FIG. 12C is a perspective view of the laterally left side one of the mount brackets 6 and the vicinity thereof in FIG. 12A as seen from front below FIG. 12D is a perspective view of the laterally left side one of the mount brackets 6 and the vicinity thereof in FIG. 12A as seen from front above. In FIG. 12D, the frame portion 12*b* is omitted in illustration to show the mount bracket 6.

As shown in FIGS. 12A to 12C, when each mount bracket 6 is set in the mounted state, the long side 61*a* of the mounted portion 61 is oriented along the right-and-left direction, whereas the short side 61*b* is oriented along the up-and-down direction. The contact portions 37 of the counterweight 3 are disposed on the mounted portions 61, respectively. As shown in FIGS. 12C and 12D, the length (lengthwise length) of the long side 61*a* of each mounted portion 61 is greater than the right-and-left directional width of the cutout 37*a* of each contact portion 37. Because of this, the contact portions 37 of the counterweight 3 can be disposed on the mounted portions 61, respectively, by disposing each mounted portion 61 such that the lengthwise direction thereof is oriented along the right-and-left direction.

By contrast, as shown in FIG. 10B, in the demounted state, each mounted portion 61 is disposed such that the crosswise direction thereof is oriented along the right-and-left direction. In the demounted state, when the counterweight 3 is moved downward with respect to the vehicle body 2, each mounted portion 61 is inserted into each groove portion 36 through each cutout 37*a*. Because of this, the length (crosswise length) of the short side 61*b* of each mounted portion 61 is shaped to be less than the right-and-left directional width of each cutout 37*a* and each groove portion 36 such that each mounted portion 61 is enabled to pass through each groove portion 36 when the counterweight 3 is detached from the vehicle body 2.

(Operating Portions 7)

Figure 13A:
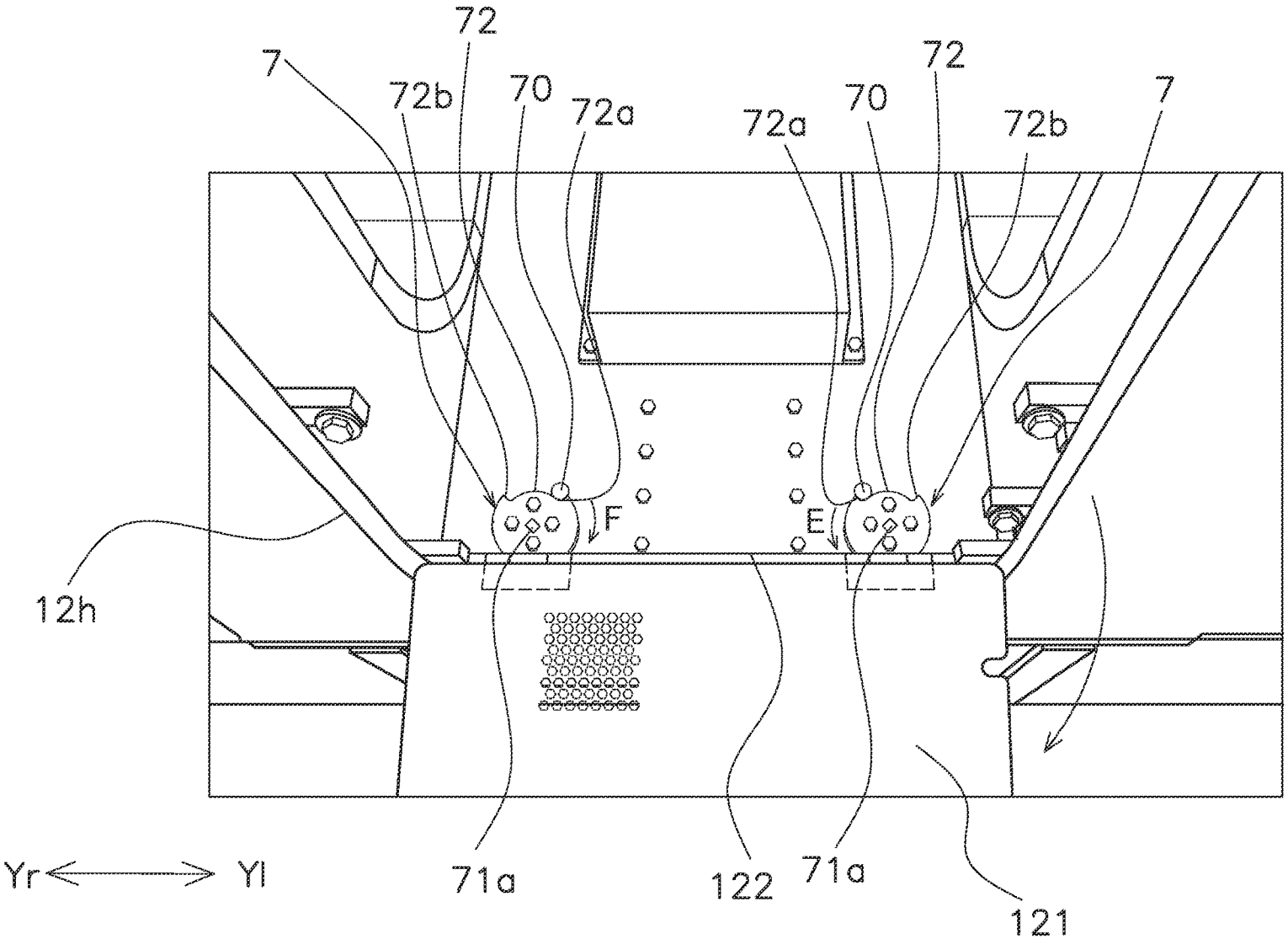
FIG. 13A is a view of a frame portion and the vicinity thereof as seen from front below in the hydraulic excavator according to the present preferred embodiment of the present disclosure.
Figure 13B:
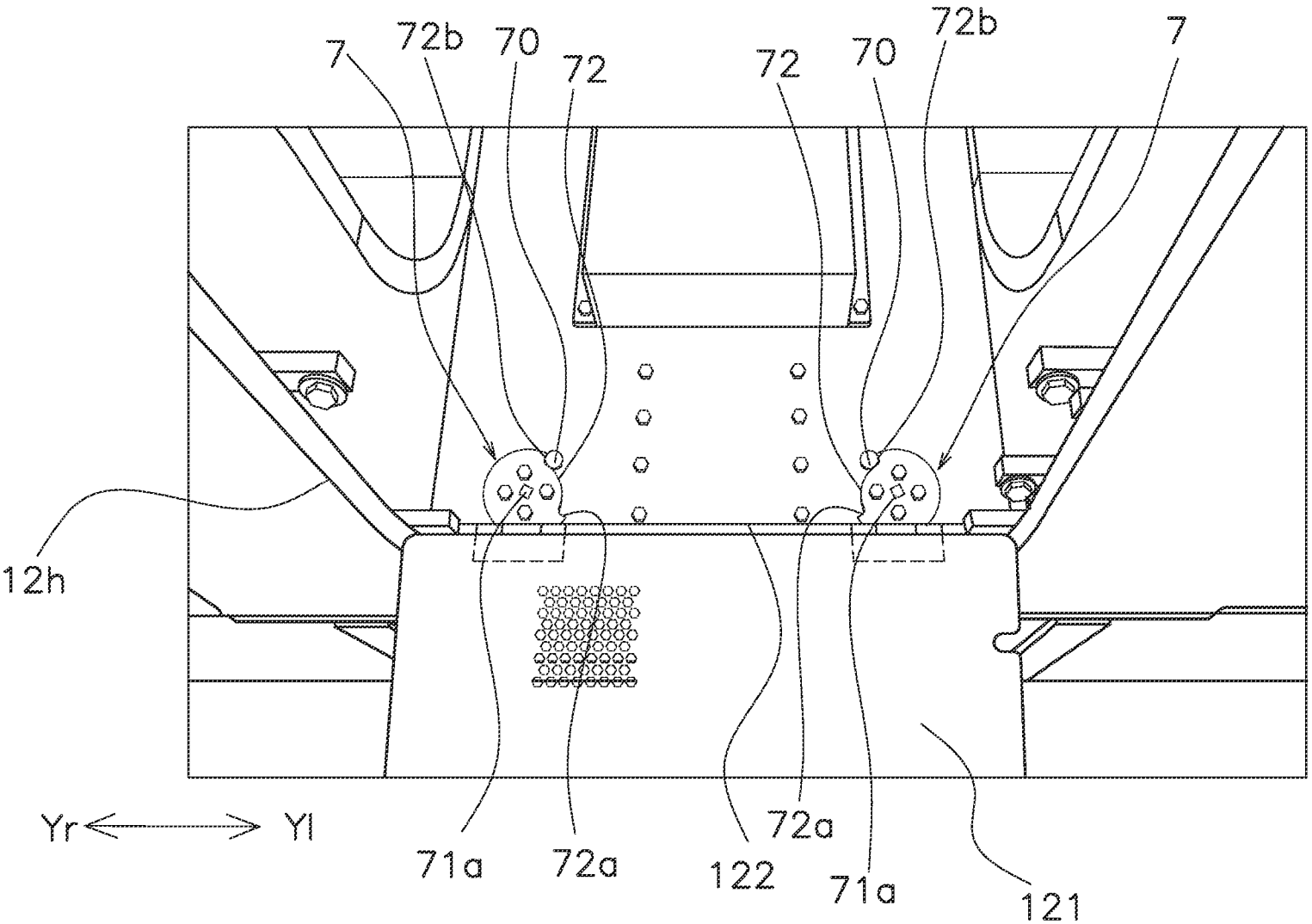
FIG. 13B is a view of a condition made when operating portions shown in FIG. 13A are operated to be turned.

FIG. 13A is a view of the frame portion 12*b* and the vicinity thereof as seen from front below FIG. 13B is a view of the frame portion 12*b* as seen from front below. FIGS. 13A and 13B show an opened state of a lid 121 made when the lid 121 is pivoted downward.

As shown in FIGS. 13A and 13B, each operating portion 7 is disposed on the front-side surface of the frame portion 12*b*. As shown in FIG. 11, each operating portion 7 is disposed on the front side of the tubular portion 12*g* welded to the frame portion 12*b*. Each operating portion 7 is fixed to the front end of the shaft portion 63 by a plurality of bolts 102. Each operating portion 7 is an approximately disc-shaped member. Each operating portion 7 is disposed such that the center axis of the disc shape thereof is arranged along the back-and-forth direction.

When each operating portion 7 is turned, the shaft portion 63 and the disc-shaped portion 62 are turned, whereby the mounted portion 61 is turned as well. When each operating portion 7 is operated to be turned, each mount bracket 6 is made changeable between the mounted state and the demounted state.

As shown in FIG. 11, each operating portion 7 is provided with an insertion hole 71*a* in a front-side surface 71 thereof, whereby a tool 8 is inserted into the insertion hole 71*a* to turn each operating portion 7. The inner surface of the insertion hole 71*a* has a polygonal shape. As shown in FIG. 11, the tool 8 includes an insertion portion 81 and a turn portion 82. The insertion portion 81 has a rod shape and the distal end thereof is made in shape of a prism having a polygonal cross section, whereby the insertion portion 81 is enabled to be inserted into the insertion hole 71*a*. The turn portion 82 has a rod shape and is attached to a base end (disposed on the opposite side of the distal end) of the insertion portion 81. The turn portion 82 is disposed to extend from the base end of the insertion portion 81 along a direction perpendicular to the insertion portion 81.

As shown in FIG. 11, the distal end of the insertion portion 81 of the tool 8 is inserted into the insertion hole 71*a*; then, the turn portion 82 is turned about the insertion portion 81 serving as the turn axis thereof. Accordingly, each operating portion 7 is turned about the back-and-forth direction serving as the turn axis thereof. For example, in the laterally left side one of the operating portions 7 shown in FIG. 11, the insertion portion 81 is inserted into the insertion hole 71*a* such that the turn portion 82 is approximately oriented in the right direction Yr; then, as seen in the rear direction, the turn portion 82 is turned counterclockwise at an angle of 90 degrees to face approximately downward. Accordingly, the corresponding one of the mount brackets 6 is changed from the mounted state into the demounted state (see FIG. 10B). The state of the turn portion 82 facing downward is depicted with dashed two-dotted line.

On the other hand, in the laterally right side one of the operating portions 7 shown in FIG. 11, the insertion portion 81 is inserted into the insertion hole 71*a* such that the turn portion 82 is approximately oriented in the left direction Yl; then, as seen in the rear direction, the turn portion 82 is turned clockwise at an angle of 90 degrees to face approximately downward. Accordingly, the corresponding other of the mount brackets 6 is changed from the mounted state into the demounted state (see FIG. 10B). The state of the turn portion 82 facing downward is depicted with dashed two-dotted line (see FIG. 11).

Turning of each operating portion 7 is restricted to the range of 90 degrees described above. As shown in FIG. 13A, protrusions 70 are disposed on the operating portion 7-side surface of the frame portion 12*b*. Besides, each operating portion 7 is provided with a cutout portion 72 shaped along the circumference thereof. The cutout portion 72 includes a first edge 72*a* and a second edge 72*b* in the circumferential direction thereof. The first and second edges 72*a* and 72*b* are opposed in the circumferential direction. An angle formed between the first and second edges 72*a* and 72*b* is 90 degrees. In the left-side operating portion 7, the first edge 72*a* is the clockwise edge of the cutout portion 72, whereas the second edge 72*b* is the counterclockwise edge. Contrarily, in the right-side operating portion 7, the first edge 72*a* is the counterclockwise edge of the cutout portion 72, whereas the second edge 72*b* is the clockwise edge.

Each protrusion 70 is disposed between the first and second edges 72*a* and 72*b*. When each protrusion 70 is contacted to the first edge 72*a*, each mount bracket 6 is changed into the mounted state; contrarily, when each protrusion 70 is contacted to the second edge 72*b*, each mount bracket 6 is changed into the demounted state. Thus, turning of each operating portion 7 is restricted to the range between the first and second edges 72*a* and 72*b* to which each protrusion 70 is contactable. FIG. 13B is a view of a condition transitioned from that shown in FIG. 13A as follows. The laterally left side one of the operating portions 7 is turned in a direction of arrow E, whereby the corresponding one of the protrusions 70 is contacted to the second edge 72*b*; contrarily, the laterally right side one of the operating portions 7 is turned in a direction of arrow F, whereby the corresponding other of the protrusions 70 is contacted to the second edge 72*b*.

As described above, the operating portions 7 are disposed on the front-side surface of the frame portion 12*b*; hence, a worker is enabled to perform an operation of turning each operating portion 7 from the engine compartment 15 side. As shown in FIG. 4, an opening 12*h* is provided between the pair of main beams 12*e*. The worker is enabled to perform the operation of turning each operating portion 7 with the tool 8, while upwardly sticking the head and the hands out of the opening 12*h*. It should be noted that in a normal work, the opening 12*h* is closed by the lid 121 shown in FIG. 13A; hence, when the front-end side of the lid 121 is pivoted downward (see arrow) about a hinge portion 122 provided on the rear side of the lid 121, the worker is enabled to perform a work through the opening 12*h*.

Actions

Next, explanation will be made for actions regarding attachment and detachment of the counterweight 3 in the hydraulic excavator 1 according to the present preferred embodiment.

FIGS. 14, 15A to 15D, and 16A to 16C are drawings for explaining the action for detaching the counterweight 3 from the vehicle body 2.

Figure 14:
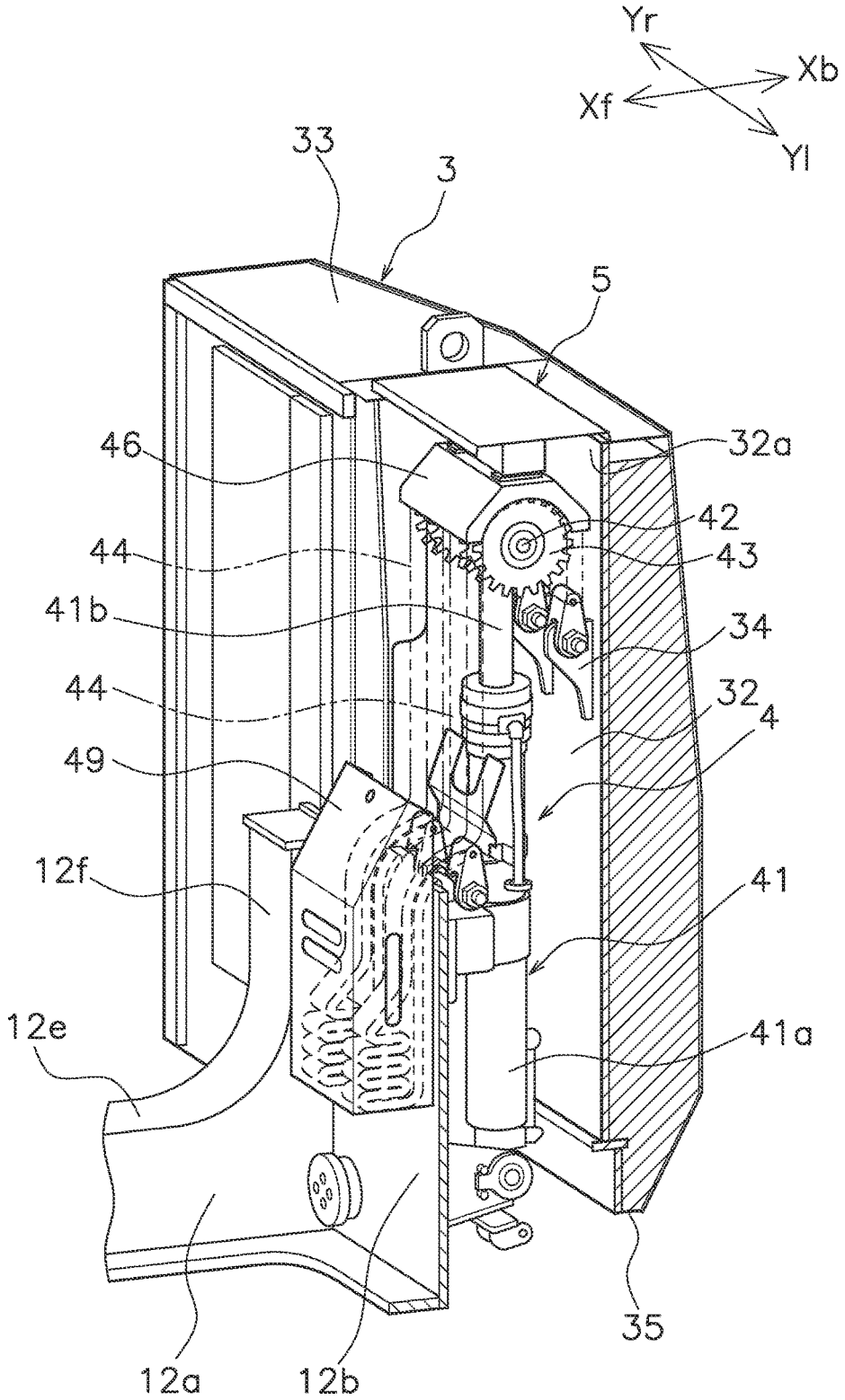
FIG. 14 is a cross-sectional view of a condition made when the counterweight is attached to the vehicle body in the hydraulic excavator according to the present preferred embodiment of the present disclosure.

FIG. 14 is a cross-sectional view of a condition that the counterweight 3 is attached to the vehicle body 2, while the opening 32*a* of the upper surface 33 thereof is closed by the upper surface cover 5. In the state shown in FIG. 14, the hydraulic excavator 1 is driven to perform a work or so forth. In the state, part of each chain 44, left without being wound, is accommodated in a storage box 49 disposed on the front-side surface of the frame portion 12*b*.

Figure 15A:
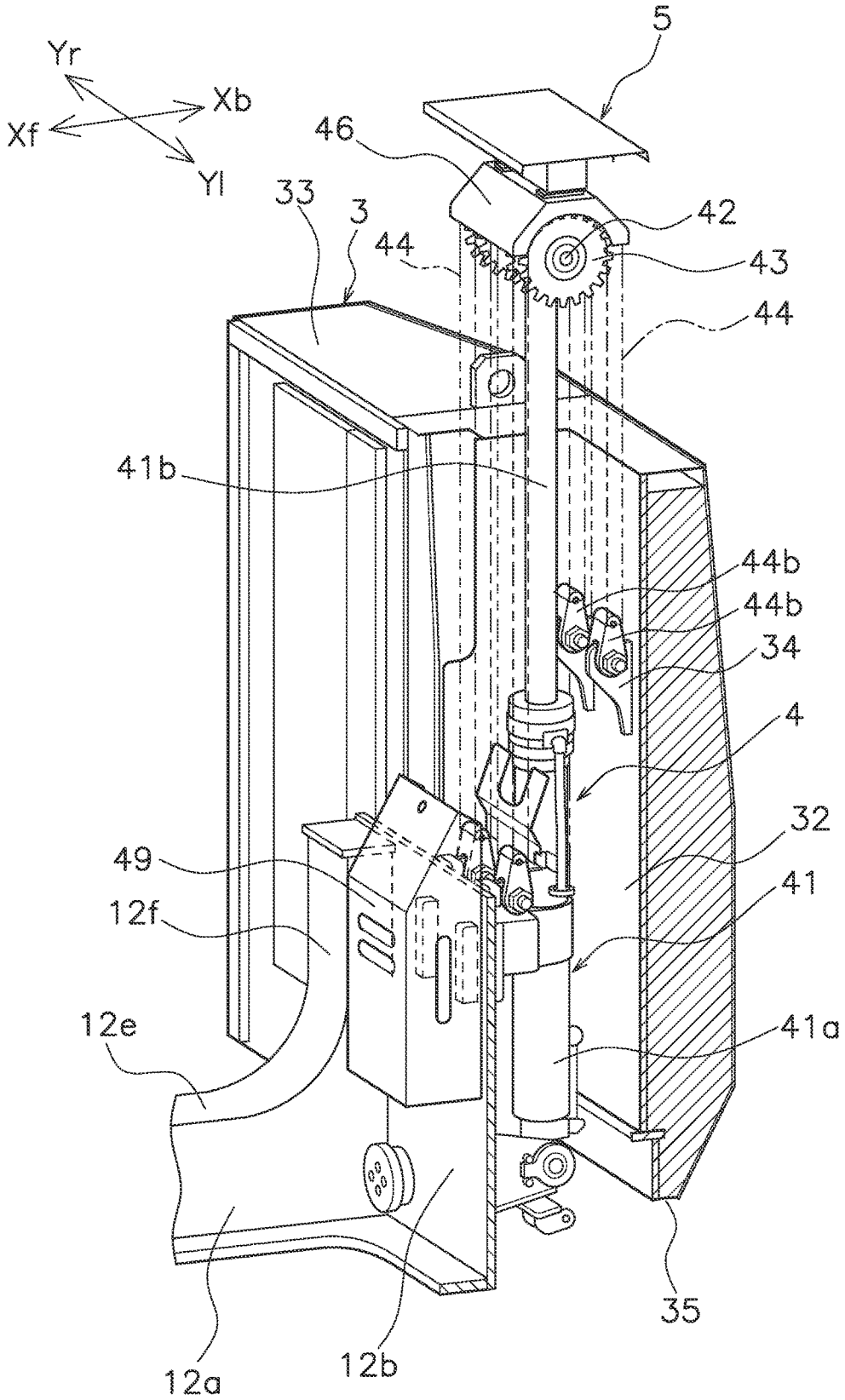
FIG. 15A is a cross-sectional view of the cylinder expanded from the state thereof shown in FIG. 14.
Figure 15B:
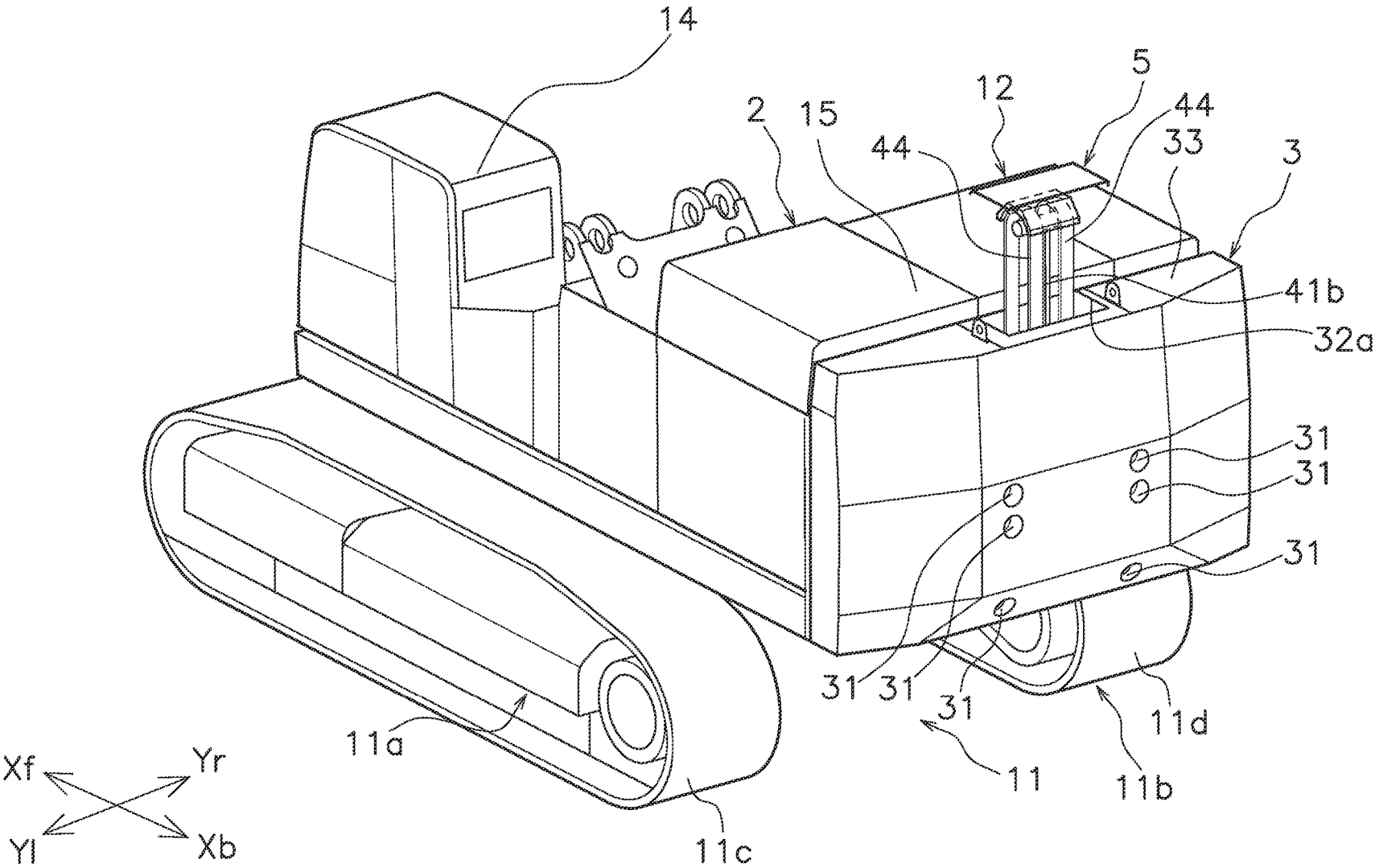
FIG. 15B is a perspective view of the entirety of the revolving unit corresponding to the state shown in FIG. 10A.

When the counterweight 3 is detached from the vehicle body 2, the cylinder 41 is expanded as shown in FIG. 15A. The hydraulic oil is supplied to the bottom-side space of the cylinder tube 41*a*, while the hydraulic oil, contained in the rod-side space of the cylinder tube 41*a*, is discharged therefrom; accordingly, the cylinder rod 41*b* is moved upward with respect to the cylinder tube 41*a*. With the expansion of the cylinder 41, the chains 44 are pulled out of the storage box 49, while the sprockets 43 are rotated. FIG. 15B is a perspective view of the vehicle body 2 in the expanded state of the cylinder 41.

In this state, the bolts, inserted into the through holes 31 perforated in the counterweight 3, are removed therefrom, whereby the counterweight 3 is released from being fastened to the frame portion 12*b*.

Figure 15C:
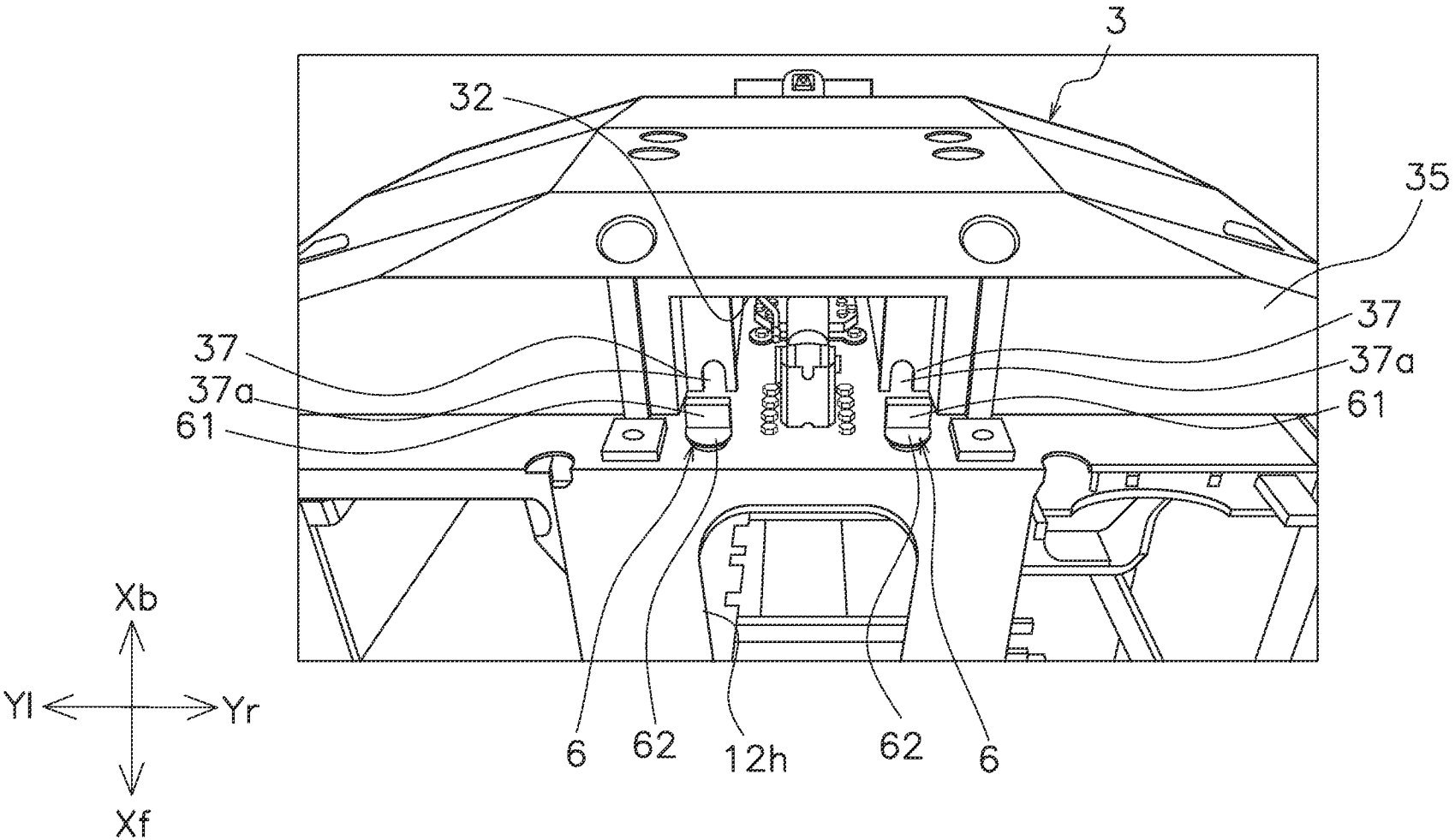
FIG. 15C is a view of a condition made when the counterweight is separated upward from the mount brackets in the hydraulic excavator according to the present preferred embodiment of the present disclosure.

Next, the cylinder 41 is further expanded, whereby the contact portions 37 of the counterweight 3 are separated upward from the mount brackets 6 as shown in FIG. 15C.

Next, the worker turns downward the lid 121 shown in FIG. 13A and then performs an operation of turning each operating portion 7 to change each mount bracket 6 from the mounted state into the demounted state with the tool 8 through the opening 12*h*. Specifically, the worker turns the laterally left side one of the operating portions 7 in the direction of arrow E from the state thereof shown in FIG. 13A, whereby the corresponding one of the protrusions 70 is contacted to the second edge 72*b* as shown in FIG. 13B. Besides, the worker turns the laterally right side one of the operating portions 7 in the direction of arrow F from the state thereof shown in FIG. 13A, whereby the corresponding other of the protrusions 70 is contacted to the second edge 72*b* as shown in FIG. 13B.

Figure 15D:
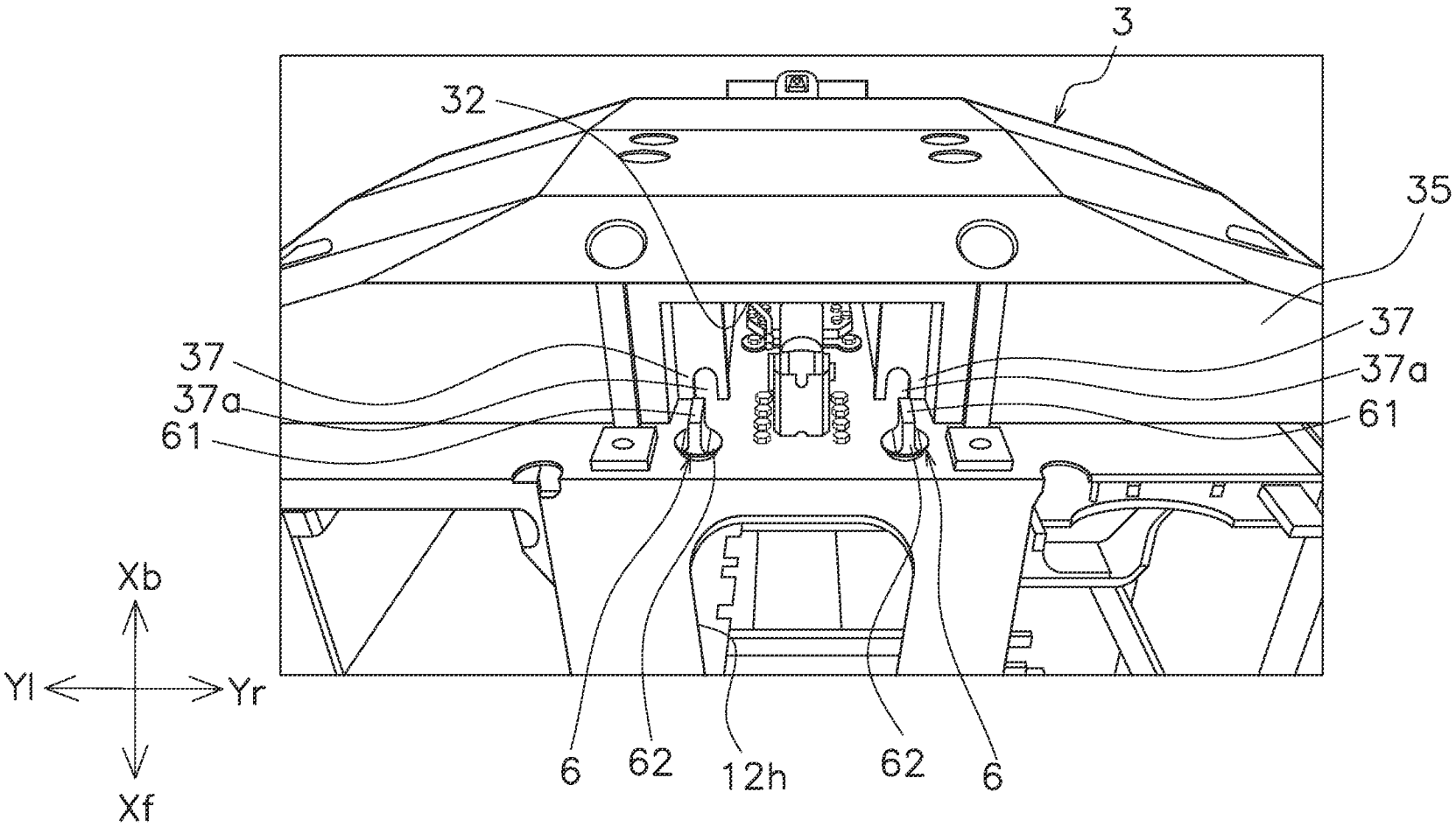
FIG. 15D is a view of the mount brackets each changed into the demounted state from a mounted state in the hydraulic excavator according to the present preferred embodiment of the present disclosure.

Accordingly, as shown in FIG. 15D, two mount brackets 6 are changed from the mounted state into the demounted state. In other words, as shown in FIG. 10B, each mounted portion 61 is disposed such that the long side 61*a* thereof is disposed along the up-and-down direction, whereas the short side 61*b* thereof is disposed along the right-and-left direction.

Figure 16A:
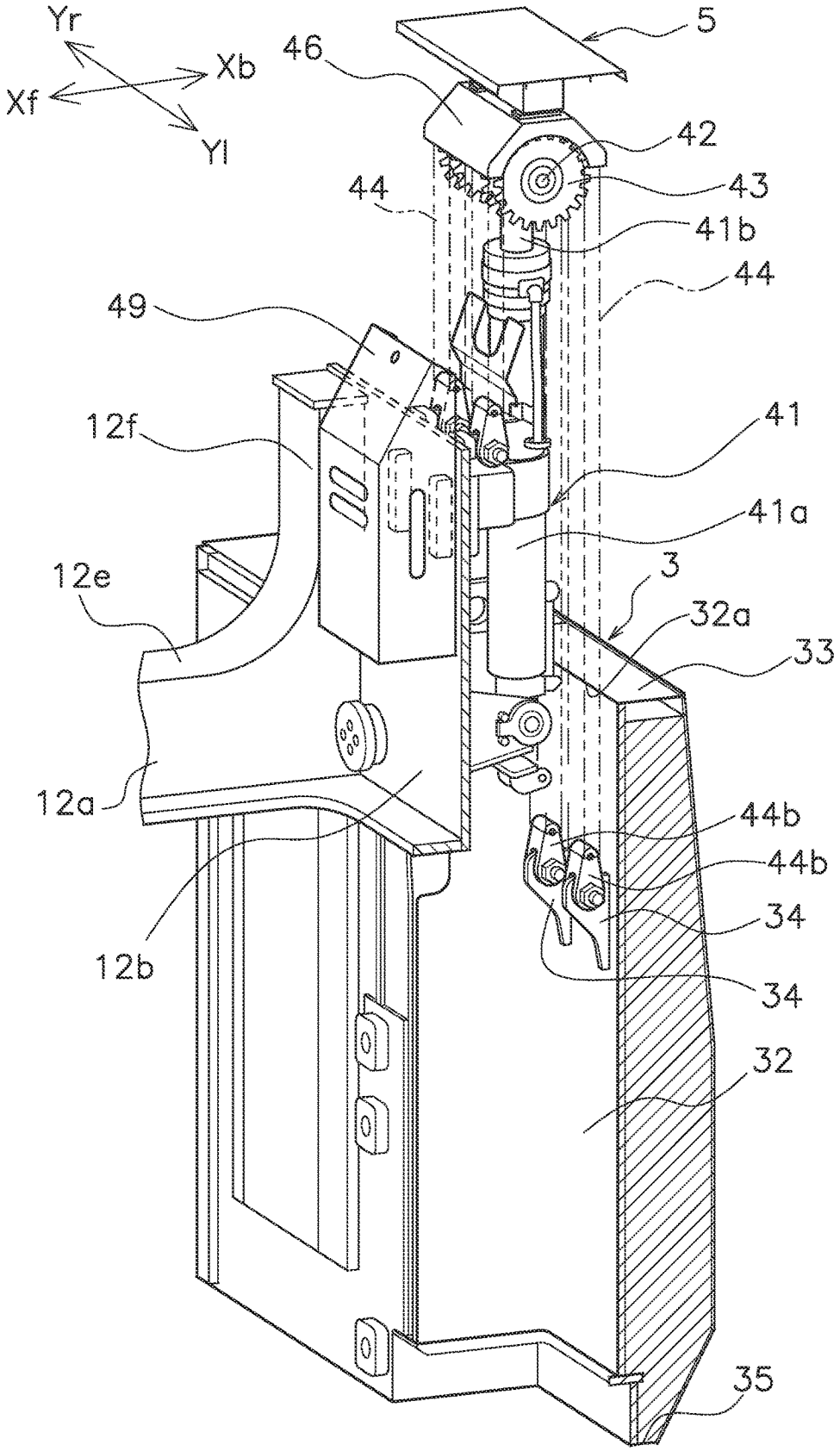
FIG. 16A is a cross-sectional view of a condition made when the counterweight is moved downward by contracting the cylinder from the state thereof shown in FIG. 15A.
Figure 16B:
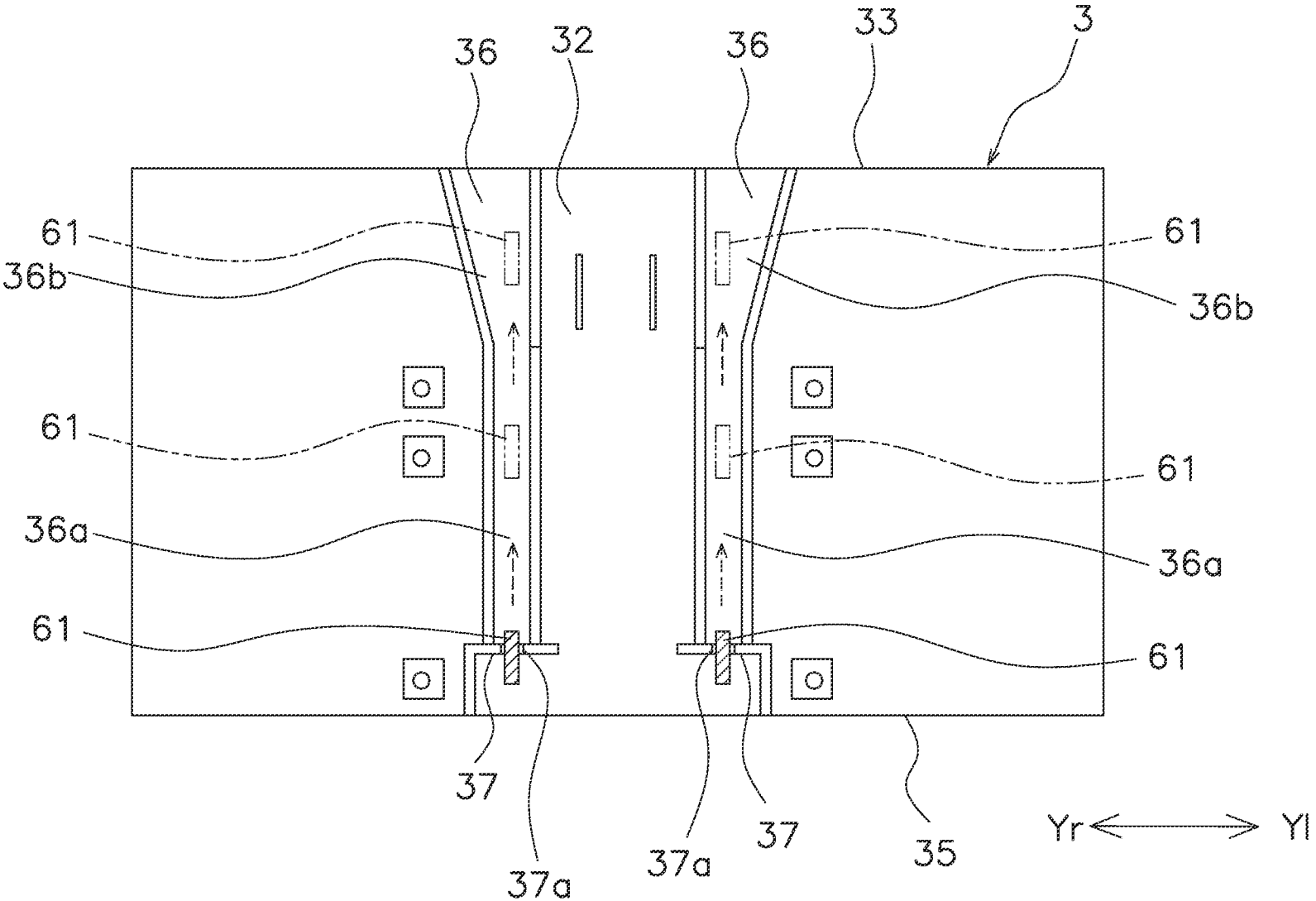
FIG. 16B is a diagram showing a positional relation of mounted portions relative to the counterweight produced when the counterweight is moved downward.

Next, as shown in FIG. 16A, the cylinder 41 is contracted. The hydraulic oil is supplied to the rod-side space of the cylinder tube 41*a*, while the hydraulic oil, contained in the bottom-side space of the cylinder tube 41*a*, is discharged therefrom, whereby the cylinder rod 41*b* is moved downward with respect to the cylinder tube 41*a*. With the contraction of the cylinder 41, the counterweight 3, connected to the end portions 44*b* of the chains 44, is moved downward, while the sprockets 43 are rotated. FIG. 16B is a diagram showing a positional relation of the mounted portions 61 relative to the counterweight 3. As shown in FIG. 16B, each mounted portion 61 is herein inserted into each groove portion 36 through each cutout 37*a* shown in FIG. 15D. As shown in FIG. 16B, with the downward movement of the counterweight 3, each mounted portion 61 is moved upward inside each groove portion 36 with respect to the counterweight 3.

Figure 16C:
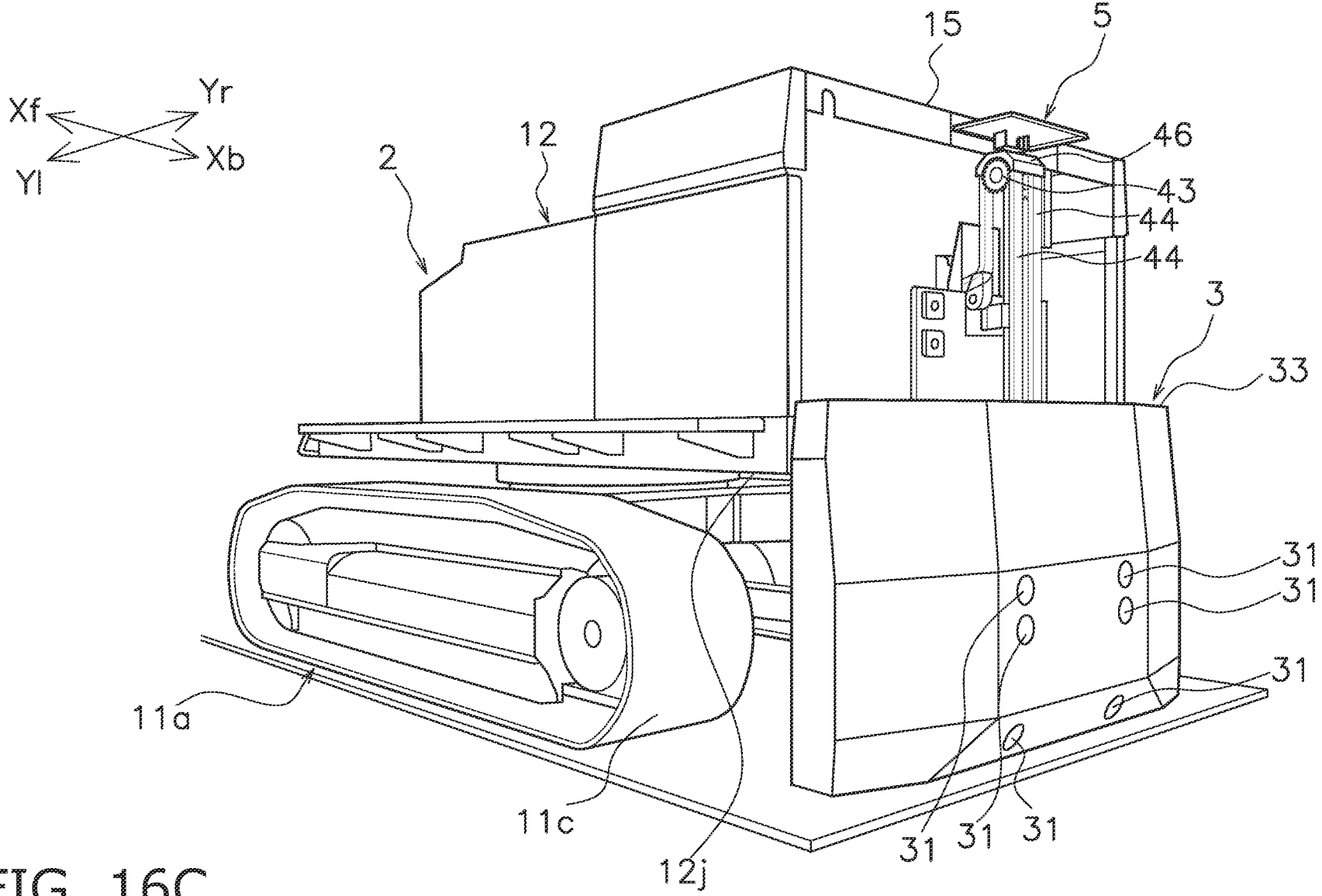
FIG. 16C is a perspective view of the entirety of the revolving unit corresponding to the state shown in FIG. 16A.

FIG. 16C is a perspective view of the vehicle body 2 in a condition that the counterweight 3 is in contact with the ground after moved downward. Height H1 (see FIG. 4), which is the height from the ground to the lower end of the revolving unit 12, is set to be less than height H2, which is the height of the counterweight 3 in the up-and-down direction. Because of this, as shown in FIG. 16C, in the state of the counterweight 3 lowered onto the ground, the upper surface 33 of the counterweight 3 is in a higher position than a lower end 12*j* of the revolving unit 12.

Next, the other end portions 44*b* of the chains 44 and the brackets 34 are disconnected from each other. Accordingly, the counterweight 3 is enabled to be detached from the vehicle body 2.

It should be noted that an action for attaching the counterweight 3 to the vehicle body 2 is performed in an approximately reverse procedure to the above.

As shown in FIG. 16C, the counterweight 3 is disposed on the rear side of the vehicle body 2. Then, the end portions 44*b* of the chains 44 are connected to the brackets 34 of the counterweight 3.

Next, as shown in FIG. 16A, the cylinder 41 is expanded, whereby the counterweight 3 is lifted upward. Each mounted portion 61 is herein moved inside each groove portion 36 with respect to the counterweight 3 and is moved out of each cutout 37*a* to the lower side of each groove portion 36.

Next, the worker performs an operation of turning each operating portion 7 to change each mount bracket 6 from the demounted state into the mounted state with the tool 8 through the opening 12*h*. Specifically, the worker turns the laterally left side one of the operating portions 7 from the state thereof shown in FIG. 13B, whereby the first edge 72*a* is contacted to the corresponding one of the protrusions 70 as shown in FIG. 13A. Besides, the worker turns the laterally right side one of the operating portions 7 from the state thereof shown in FIG. 13B, whereby the first edge 72*a* is contacted to the corresponding other of the protrusions 70 as shown in FIG. 13A.

Next, the cylinder 41 is slightly contracted, whereby the counterweight 3 is disposed on the mounted portions 61 of the mount brackets 6.

Next, the six bolts are inserted from behind into the six insertion holes 12*c* via the six through holes 31, respectively, whereby the counterweight 3 is fixed to the frame portion 12*b*.

Next, as shown in FIG. 14, the cylinder 41 is contracted, whereby part of each chain 44, left without being wound, is stored in the storage box 49 by the weight thereof, while the upper surface cover 5 closes the opening 32*a* of the counterweight 3.

The hydraulic excavator 1 (exemplary work machine) according to the present preferred embodiment includes the vehicle body 2, the counterweight 3, the mount bracket 6, and the operating portion 7. The counterweight 3 is attachable/detachable to/from the frame portion 12*b* of a rear part of the vehicle body. The mount bracket 6 is disposed on the frame portion 12*b* to be changeable between the mounted state and the demounted state. The mount bracket 6 is changed into the mounted state in mounting the counterweight 3 thereto, with the counterweight 3 being attached to the vehicle body 2. The mount bracket 6 is changed into the demounted state in detachment of the counterweight 3 from the vehicle body 2. The operating portion 7 is disposed on the opposite side of the counterweight 3 on the frame portion 12*b* as seen in the back-and-forth direction of the vehicle body and is operated such that the mount bracket 6 is changed into either the mounted state or the demounted state.

Thus, the operating portion 7 for operating the mount bracket 6 is disposed on the opposite side of the counterweight 3 on the frame portion 12*b*. Because of this, the worker is not required to operate the mount bracket 6 across the counterweight 3; this makes it easy for the worker to operate the operating portion 7. Accordingly, the worker is enabled to easily operate the mount bracket 6 between the mounted state and the demounted state.

In the hydraulic excavator 1 (exemplary work machine) according to the present preferred embodiment, the mount bracket 6 is disposed on the frame portion 12*b* to be turnable about the back-and-forth direction of the vehicle body serving as the turn axis thereof and is made changeable between the mounted state and the demounted state when turned. The operating portion 7 is connected to the mount bracket 6. The mount bracket 6 is turned when the operating portion 7 is operated to be turned about the back-and-forth direction of the vehicle body serving as the turn axis thereof.

With the configuration, when the operating portion 7 is operated to be turned about the back-and-forth direction serving as the turn axis thereof, the mount bracket 6 can be turned to be changed into either the mounted state or the demounted state.

In the hydraulic excavator 1 (exemplary work machine) according to the present preferred embodiment, the operating portion 7 includes the insertion hole 71*a*, in which the tool for operating the operating portion 7 is inserted, and which is provided in the surface 71 disposed on the opposite side of the counterweight 3 as seen in the back-and-forth direction of the vehicle body.

With the configuration, the tool 8 is inserted into the insertion hole 71*a* from the opposite side of the counterweight 3 with reference to the frame portion 12*b*, whereby the operating portion 7 can be operated by the tool 8.

In the hydraulic excavator 1 (exemplary work machine) according to the present preferred embodiment, the mount bracket 6 is changed from the mounted state into the demounted state when turned by 90 degrees (exemplary predetermined angle) in a first direction; contrarily, the mount bracket 6 is changed from the demounted state into the mounted state when turned by 90 degrees (exemplary predetermined angle) in a second direction reverse to the first direction. The hydraulic excavator 1 further includes the protrusion 70 (exemplary restriction portion) restricting turning of the operating portion 7 such that the mount bracket 6 is turned within a range of the predetermined angle.

With the configuration, turning of the operating portion 7 can be restricted such that the mount bracket 6 is changed into either the mounted state or the demounted state.

In the hydraulic excavator 1 (exemplary work machine) according to the present preferred embodiment, the protrusion 70 is provided on the operating portion 7-side surface of the frame portion 12*b*. The operating portion 7 includes the cutout portion 72 provided along the circumferential direction thereof. The protrusion 70 is contacted to the first edge 72*a* of the cutout portion 72 in the circumferential direction when the operating portion 7 is turned such that the mount bracket 6 is changed into the mounted state; contrarily, the protrusion 70 is contacted to the second edge 72*b* of the cutout portion 72, opposed to the first edge 72*a* in the circumferential direction, when the operating portion 7 is turned such that the mount bracket 6 is changed into the demounted state.

With the configuration, the mount bracket 6 can be set in place to the mounted state by turning the operating portion 7 until the first edge 72*a* is contacted to the protrusion 70; contrarily, the mount bracket 6 can be set in place to the demounted state by turning the operating portion 7 until the second edge 72*b* is contacted to the protrusion 70.

In the hydraulic excavator 1 (exemplary work machine) according to the present preferred embodiment, the counterweight 3 includes the groove portion 36 provided on the frame portion 12*b*-side surface thereof along the up-and-down direction. The mount bracket 6 includes the mounted portion 61 on which the counterweight 3 is mounted, with the counterweight 3 being attached to the vehicle body 2. In the mounted state of the mount bracket 6, the mounted portion 61 is disposed such that the lengthwise direction thereof is oriented along the right-and-left direction as seen along the back-and-forth direction, while the crosswise direction thereof is oriented along the up-and-down direction. Besides, the mounted portion 61 receives the contact portion 37 (exemplary surrounding portion) of the lower end of the groove portion 36 mounted thereto, with the counterweight 3 being attached to the vehicle body 2. In the demounted state of the mount bracket 6, the mounted portion 61 is disposed such that the lengthwise direction thereof is oriented along the up-and-down direction, while the crosswise direction thereof is oriented along the right-and-left direction. Besides, the mounted portion 61 passes through the groove portion 36 in detachment of the counterweight 3 from the vehicle body 2.

With the configuration, the counterweight 3 is supported by the mount bracket 6 set in the demounted state; then, when the mount bracket 6 is changed into the demounted state, detachment of the counterweight 3 is enabled by causing the mounted portion 61 to pass through the inside of the groove portion 36. Besides, the counterweight 3 is mounted to the mount bracket 6, whereby positional alignment between the insertion holes 12*c* and the through holes 31 can be easily made when the counterweight 3 is attached to the frame portion 12*b* by the bolts.

In the hydraulic excavator 1 (exemplary work machine) according to the present preferred embodiment, the vehicle body 2 includes the main beam 12*e* shaped along the back-and-forth direction. The main beam 12*e* includes the raised portion 12*f* raised upward at the rear end thereof. The frame portion 12*b* is attached to the raised portion 12*f*.

With the configuration, the frame portion 12*b*, to which the counterweight 3 is attached, is attached to the raised portion 12*f* of the main beam 12*e*.

In the hydraulic excavator 1 (exemplary work machine) according to the present preferred embodiment, the vehicle body 2 includes the traveling unit 11 and the revolving unit 12 disposed on the upper side of the traveling unit 11. The height H1 from the ground to the lower end of the revolving unit 12 is less than the height H2 of the counterweight 3 in the up-and-down direction.

With the configuration, when the counterweight 3 is detached from the vehicle body 2 and is then put on the ground, even if the counterweight 3 is about to tilt and fall, the counterweight 3 can be supported by the vehicle body 2.

The hydraulic excavator 1 (exemplary work machine) according to the present preferred embodiment further includes the attachment/detachment device 4. The attachment/detachment device 4 is disposed in the recessed portion 32 (exemplary storage portion) provided in the counterweight 3, with the counterweight 3 being attached to the vehicle body 2. The attachment/detachment device 4 expands/contracts in the up-and-down direction through the opening 32*a* provided above the recessed portion 32 in attachment/detachment of the counterweight 3 to/from the vehicle body 2.

With the configuration, attachment/detachment of the counterweight 3 to/from the vehicle body 2 is enabled without bringing a crane vehicle or so forth.

One preferred embodiment of the present invention has been explained above. However, the present invention is not limited to the preferred embodiment described above, and a variety of changes can be made without departing from the gist of the present invention.

In the preferred embodiment described above, two mount brackets 6 are disposed in alignment in the right-and-left direction; however, the mount brackets 6 may not be limited in number to two. Only one mount bracket 6 may be provided insomuch as the counterweight 3 can be thereby supported. Alternatively, three or more mount brackets 6 may be disposed.

In the preferred embodiment described above, the bushing 64 is disposed outside the shaft portion 63 of each mount bracket 6; however, the bushing 64 may not be disposed.

In the preferred embodiment described above, each operating portion 7 is provided with the cutout portion 72; besides, each protrusion 70 is contacted to the edges of the cutout portion 72, whereby the turn range of each operating portion 7 is restricted. However, the structure for restricting the turn range of each operating portion is not limited to this. For example, each operating portion 7, having a disc shape, may be provided with two protruding portions that protrude outward therefrom and are separated from each other at a predetermined interval; then, each protrusion 70 may be disposed between the protruding portions. When either of the protruding portions is contacted to the protrusion 70 provided on the frame portion 12*b*, turning of each operating portion is restricted. Contrarily, each operating portion 7 may be provided with one protruding portion, whereas two protrusions 70 may be disposed to interpose the protruding portion therebetween in the circumferential direction.

In the preferred embodiment described above, the cylinder 41 is used as an expansion/contraction mechanism for the attachment/detachment device 4; besides, the hydraulic cylinder is exemplified as the cylinder 41. However, the cylinder 41 may not be limited in configuration to this; instead, an electric cylinder may be used as the cylinder 41. Besides, the expansion/contraction mechanism may not be limited to the cylinder; instead, such an actuator as being configured to slide in expansion and contraction may be used as the expansion/contraction mechanism.

In the preferred embodiment described above, the sprockets 43 and the chains 44 are used as the attachment/detachment device 4; however, the attachment/detachment device 4 is not limited in configuration to this. For example, pulleys, wires, and so forth may be used as the attachment/detachment device 4.

In the preferred embodiment described above, explanation has been made by exemplifying the hydraulic excavator as the work vehicle; however, the work machine is not limited to the hydraulic excavator. The present invention is applicable to another type of work machine provided with a counterweight such as a wheel loader.

According to the present disclosure, it is made possible to provide a work machine in which a mount bracket can be easily operated in attachment/detachment of a counterweight; hence, the present disclosure is useful when applied to a hydraulic excavator or so forth.

The invention claimed is:

1. A work machine comprising:

a vehicle body;

a counterweight configured to be attachable to and detachable from a frame portion of a rear part of the vehicle body;

a mount bracket disposed on the frame portion and configured to be changeable between a mounted state and a demounted state, the mount bracket being changed to the mounted state in mounting the counterweight thereto, with the counterweight being attached to the vehicle body, the mount bracket being changed to the demounted state in detachment of the counterweight from the vehicle body; and an operating portion disposed on an opposite side of the counterweight on the frame portion as seen in a back-and-forth direction of the vehicle body, the operating portion being configured to be operated such that the mount bracket is changed to either the mounted state or the demounted state, the counterweight supported by an upper surface of the mount bracket in the mounted state, and the operating portion being connected to the mount bracket, the mount bracket being movable by an operation of the operating portion between the mounted state and the demounted state.

2. The work machine according to claim 1, wherein the mount bracket is disposed on the frame portion to be turnable about the back-and-forth direction of the vehicle body serving as a turn axis thereof, the mount bracket being configured to be changeable between the mounted state and the demounted state when turned, the operating portion is connected to the mount bracket, and the mount bracket is turned when the operating portion is operated to be turned about the back-and-forth direction of the vehicle body serving as a turn axis thereof.

3. The work machine according to claim 1, wherein the operating portion includes an insertion hole in which a tool for operating the operating portion is inserted, the insertion hole being provided in a surface of the operating portion disposed on an opposite side of the counterweight as seen in the back-and-forth direction of the vehicle body.

4. The work machine according to claim 2, wherein the mount bracket is changed from the mounted state into the demounted state when turned by a predetermined angle in a first direction, the mount bracket being changed from the demounted state to the mounted state when turned by the predetermined angle in a second direction reverse to the first direction, the work machine further including a restriction portion restricting turning of the operating portion such that the mount bracket is turned within a range of the predetermined angle.

5. The work machine according to claim 4, wherein the restriction portion includes a protrusion provided on an operating portion-side surface of the frame portion, the operating portion includes a cutout portion provided along a circumferential direction thereof, and the protrusion is configured to contact a first edge of the cutout portion in the circumferential direction when the operating portion is turned such that the mount bracket is changed to the mounted state, the protrusion being configured to contact a second edge of the cutout portion opposed to the first edge in the circumferential direction when the operating portion is turned such that the mount bracket is changed to the demounted state.

6. The work machine according to claim 1, wherein the counterweight includes a groove portion provided on a frame portion-side surface thereof along an up-and-down direction, the mount bracket includes a mounted portion on which the counterweight is mounted, with the counterweight being attached to the vehicle body, in the mounted state of the mount bracket, the mounted portion is disposed such that a lengthwise direction thereof is oriented along a right-and-left direction as seen along the back-and-forth direction, while a crosswise direction thereof is oriented along the up-and-down direction, the mounted portion receiving a surrounding portion of a lower end of the groove portion mounted thereto, with the counterweight being attached to the vehicle body, and in the demounted state of the mount bracket, the mounted portion is disposed such that the lengthwise direction thereof is oriented along the up-and-down direction, while the crosswise direction thereof is oriented along the right-and-left direction, the mounted portion passing through the groove portion in detachment of the counterweight from the vehicle body.

7. The work machine according to claim 1, wherein the vehicle body includes a main beam shaped along the back-and-forth direction, the main beam includes a raised portion raised upward at a rear end thereof, and the frame portion is attached to the raised portion.

8. The work machine according to claim 1, wherein the vehicle body includes a traveling unit and a revolving unit disposed on an upper side of the traveling unit, and a length from a ground to a lower end of the revolving unit in an up-and-down direction is less than a length of the counterweight in the up-and-down direction.

9. The work machine according to claim 1, further comprising an attachment/detachment device disposed in a storage portion provided in the counterweight, with the counterweight being attached to the vehicle body, the attachment/detachment device being configured to expand and contract in an up-and-down direction through an opening provided above the storage portion in attachment of the counterweight to the vehicle body and detachment of the counterweight from the vehicle body.

10. The work machine according to claim 1, further comprising an attachment/detachment device configured to attach the counterweight to the vehicle body and detach the counterweight from the vehicle body, the attachment/detachment device being disposed on the frame portion.

11. A work machine comprising:

a vehicle body;

a counterweight configured to be attachable to and detachable from a frame portion of a rear part of the vehicle body;

a mount bracket disposed on the frame portion and configured to be changeable between a mounted state and a demounted state, the mount bracket being changed to the mounted state in mounting the counterweight thereto, with the counterweight being attached to the vehicle body, the mount bracket being changed to the demounted state in detachment of the counterweight from the vehicle body; and an operating portion disposed on an opposite side of the counterweight on the frame portion as seen in a back-and-forth direction of the vehicle body, the operating portion being configured to be operated such that the mount bracket is changed to either the mounted state or the demounted state, the operating portion including an insertion hole in which a tool for operating the operating portion is inserted, the insertion hole being provided in a surface of the operating portion disposed on an opposite side of the counterweight as seen in the back-and-forth direction of the vehicle body.

12. The work machine according to claim 11, wherein the mount bracket is disposed on the frame portion to be turnable about the back-and-forth direction of the vehicle body serving as a turn axis thereof, the mount bracket being configured to be changeable between the mounted state and the demounted state when turned, the operating portion is connected to the mount bracket, and the mount bracket is turned when the operating portion is operated to be turned about the back-and-forth direction of the vehicle body serving as a turn axis thereof.

13. The work machine according to claim 11, wherein the vehicle body includes a main beam shaped along the back-and-forth direction, the main beam includes a raised portion raised upward at a rear end thereof, and the frame portion is attached to the raised portion.

14. The work machine according to claim 11, wherein the vehicle body includes a traveling unit and a revolving unit disposed on an upper side of the traveling unit, and a length from a ground to a lower end of the revolving unit in an up-and-down direction is less than a length of the counterweight in the up-and-down direction.

15. The work machine according to claim 11, further comprising an attachment/detachment device disposed in a storage portion provided in the counterweight, with the counterweight being attached to the vehicle body, the attachment/detachment device being configured to expand and contract in an up-and-down direction through an opening provided above the storage portion in attachment of the counterweight to the vehicle body and detachment of the counterweight from the vehicle body.

16. A work machine comprising:

a vehicle body;

a counterweight configured to be attachable to and detachable from a frame portion of a rear part of the vehicle body;

a mount bracket disposed on the frame portion and configured to be changeable between a mounted state and a demounted state, the mount bracket being changed to the mounted state in mounting the counterweight thereto, with the counterweight being attached to the vehicle body, the mount bracket being changed to the demounted state in detachment of the counterweight from the vehicle body; and an operating portion disposed on an opposite side of the counterweight on the frame portion as seen in a back-and-forth direction of the vehicle body, the operating portion being configured to be operated such that the mount bracket is changed to either the mounted state or the demounted state, the vehicle body including a main beam shaped along the back-and-forth direction, the main beam including a raised portion raised upward at a rear end thereof, and the frame portion being attached to the raised portion.

17. The work machine according to claim 16, wherein the mount bracket is disposed on the frame portion to be turnable about the back-and-forth direction of the vehicle body serving as a turn axis thereof, the mount bracket being configured to be changeable between the mounted state and the demounted state when turned, the operating portion is connected to the mount bracket, and the mount bracket is turned when the operating portion is operated to be turned about the back-and-forth direction of the vehicle body serving as a turn axis thereof.

18. The work machine according to claim 16, wherein the operating portion includes an insertion hole in which a tool for operating the operating portion is inserted, the insertion hole being provided in a surface of the operating portion disposed on an opposite side of the counterweight as seen in the back-and-forth direction of the vehicle body.

19. The work machine according to claim 16, wherein the vehicle body includes a traveling unit and a revolving unit disposed on an upper side of the traveling unit, and a length from a ground to a lower end of the revolving unit in an up-and-down direction is less than a length of the counterweight in the up-and-down direction.

20. The work machine according to claim 16, further comprising an attachment/detachment device disposed in a storage portion provided in the counterweight, with the counterweight being attached to the vehicle body, the attachment/detachment device being configured to expand and contract in an up-and-down direction through an opening provided above the storage portion in attachment of the counterweight to the vehicle body and detachment of the counterweight from the vehicle body.

* * * * *